US006075548A

United States Patent [19]

Gillen

[11] Patent Number: 6,075,548

[45] Date of Patent: Jun. 13, 2000

[54] PRINTERS HAVING ADJUSTABLE RESOLUTION AND METHODS OF FORMING AN IMAGE

[75] Inventor: John D. Gillen, Spokane, Wash.

[73] Assignee: Output Technology Corporation, Spokane, Wash.

[21] Appl. No.: 08/991,259

[22] Filed: Dec. 16, 1997

[51] Int. Cl.[7] ..... B41J 2/385; B41J 2/47; G03G 13/04

[52] U.S. Cl. ..... 347/139; 347/234

[58] Field of Search ..... 346/136; 347/3, 347/139, 234, 237, 251, 262, 258, 15, 43, 116, 131; 399/92, 96, 384, 330, 394, 396; 358/296, 298, 406, 300, 455, 504, 521, 527; 400/120.01, 120.02; 101/DIG. 37

[56] References Cited

U.S. PATENT DOCUMENTS

| | | | |
|---|---|---|---|
| 4,011,353 | 3/1977 | Okamoto et al. | 399/325 |
| 4,891,656 | 1/1990 | Kubelik | 347/127 |
| 4,958,172 | 9/1990 | McCallum et al. | 347/125 |
| 4,990,942 | 2/1991 | Therrien et al. | 347/128 |
| 4,999,653 | 3/1991 | McCallum | 347/127 |
| 5,006,869 | 4/1991 | Buchan et al. | 347/127 |
| 5,030,975 | 7/1991 | McCallum et al. | 347/148 |
| 5,164,742 | 11/1992 | Baek et al. | 347/234 |
| 5,278,588 | 1/1994 | Kubelik | 347/127 |
| 5,315,324 | 5/1994 | Kubelik et al. | 347/120 |
| 5,345,315 | 9/1994 | Shalit | 358/406 |
| 5,442,382 | 8/1995 | Pfeuffer | 347/139 |
| 5,450,103 | 9/1995 | Kubelik | 347/123 |
| 5,778,382 | 8/1998 | Egbert et al. | 400/118.3 |
| 5,781,225 | 7/1998 | Syracuse et al. | 347/258 |

*Primary Examiner*—N. Le
*Assistant Examiner*—L. Anderson
*Attorney, Agent, or Firm*—Wells, St. John, Roberts, Gregory & Matkin P.S.

[57] ABSTRACT

The present invention provides printers and methods of forming an image. One embodiment of the invention provides a printer including a frame; a drive assembly coupled with the frame and configured to transport media along a media path within the printer; an imaging assembly configured to receive a plurality of images and provide the images upon the media; and an image controller configured to selectively vary the resolution of the images. A method of forming an image according to the invention comprises providing media at a print velocity; providing a first reference signal; converting the first reference signal to a second reference signal; forming an image upon media according to the second reference signal; following the forming, outputting media having the image thereon; and adjusting the second reference signal responsive to the forming.

42 Claims, 21 Drawing Sheets

PRINTERS HAVING ADJUSTABLE RESOLUTION AND METHODS OF FORMING AN IMAGE

TECHNICAL FIELD

The present invention relates to printers and methods of forming an image.

BACKGROUND OF THE INVENTION

Numerous printers, printing assemblies, and printing techniques have been developed for various printing and image production applications. One exemplary printing technique is offset printing. Offset printing typically provides favorable characteristics of printing at high speeds as well as producing good qualities.

Offset printers are typically configured to initially provide an image to be printed upon a drum. Thereafter, the image is transferred to the paper or other media being printed. It is preferred to provide a drum surface which provides maximum transfer of ink, toner or other substance utilized to form the image upon the media. Thus, it is not uncommon for the outer surface of the drum to comprise a soft, elastic, and pliable material. The utilization of such a material is preferred to facilitate reception of the image and development of the image, as well as provide accurate transfer of the image to the media being printed upon.

Certain difficulties have been experienced in the art with the utilization of soft, elastic drum surfaces despite the advantageous characteristics provided thereby. One recognized problem is a printing process phenomena called "creep". Creep causes a uniform deformation of the printed image in the process direction due to the use of elastic printing nips. Such deformation often occurs during transfer of the image from the image generating device to a receiving drum of the printer and during transfer of the image from the receiving drum to the media.

As a result, the resultant image may be either too small or too large for the form. In particular, the resolution of the originally provided image is expanded and contracted through the offset printing process resulting in a net linear change when the image is finally transferred to the media. This printing phenomenon often results in the production of a printed image upon the media which may be either too small or too large for the form.

Therefore, it is desirable to provide a printer which achieves the benefits of offset printing devices while overcoming the problems associated therewith.

BRIEF DESCRIPTION OF THE DRAWINGS

Preferred embodiments of the invention are described below with reference to the following accompanying drawings.

FIG. 6 is an isometric view of an embodiment of a print head of the printer.

FIG. 7 is a functional block diagram of an embodiment of a tachometer synthesizer of the printer.

FIG. 8 is a graph illustrating how FIG. 8A–FIG. 8L of a multiplier and counter of the tachometer synthesizer are assembled.

FIG. 8A–FIG. 8L are schematic diagrams illustrating components of one embodiment of the multiplier and counter.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

A first aspect of the present provides a printer comprising a frame; a drive assembly coupled with the frame and configured to transport media along a media path within the printer; an imaging assembly configured to receive a plurality of images and provide the images upon the media; and an image controller configured to selectively vary the resolution of the images.

A method of forming an image according to the invention comprises providing media at a print velocity; providing a first reference signal; converting the first reference signal to a second reference signal; forming an image upon media according to the second reference signal; following the forming, outputting media having the image thereon; and adjusting the second reference signal responsive to the forming.

A next aspect of the invention provides a method of forming images upon media comprising providing media at a print velocity; providing a plurality of images; forming the images upon an imaging drum; adjusting the resolution of the images; offsetting the images from the imaging drum to the media; and outputting the media following the offsetting.

Another aspect of the present invention provides a method of forming an image comprising: providing media at a print velocity; providing a plurality of images; first forming a plurality of latent images corresponding to the provided images; adjusting the resolution of the latent images; second forming the images upon the media; and outputting the media following the second forming.

Figure 1:
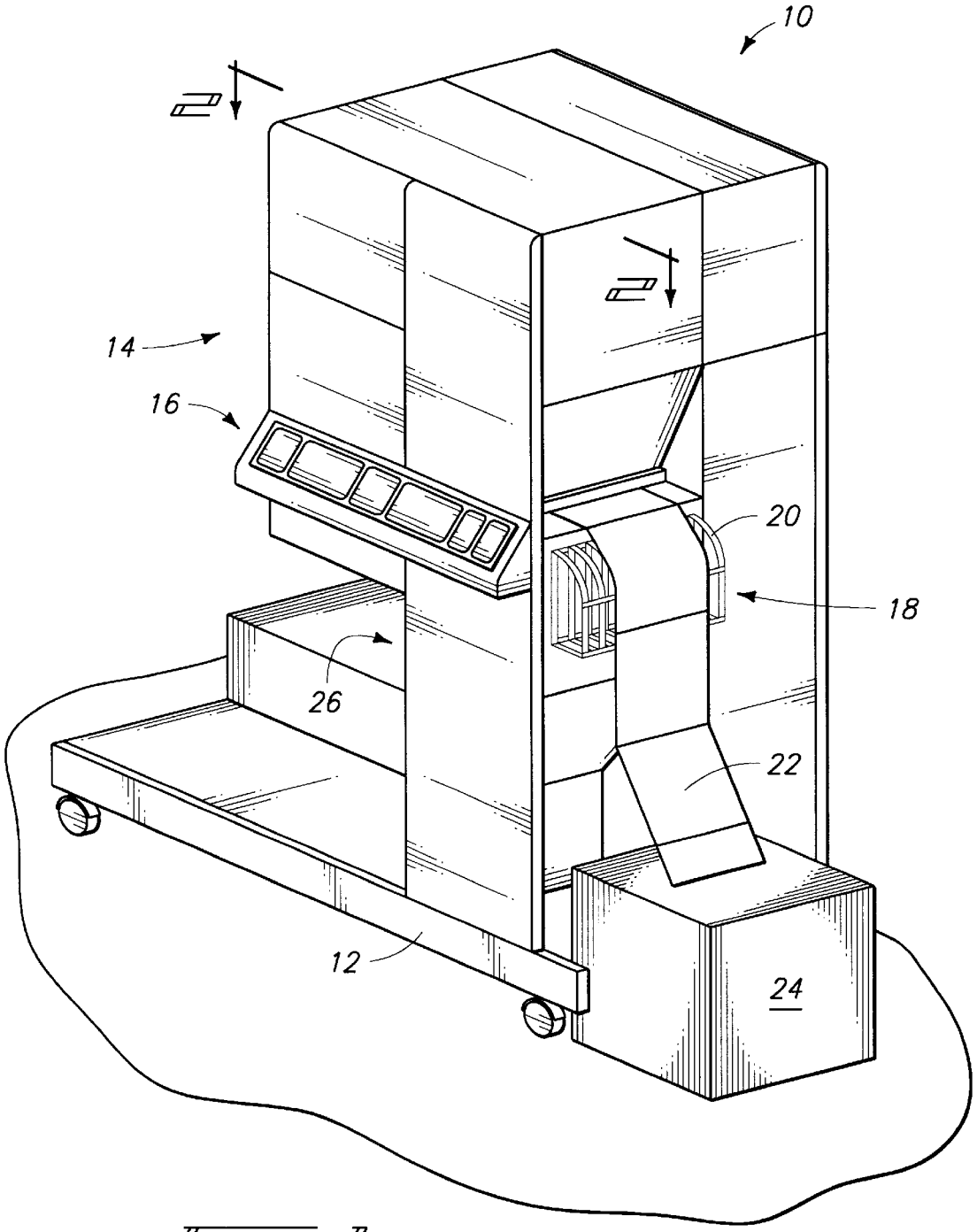
FIG. 1 is an isometric view of one embodiment of a printer in accordance with the present invention.

The printer of the present invention is generally illustrated by numeral 10 in FIG. 1. The illustrated printer 10 is a continuous form printer configured to form or print images upon plural sheets of media, such as paper, which are joined to form a continuous web.

The depicted embodiment of the printer 10 comprises a base portion 12 and housing 14 connected therewith. A control panel 16 which provides user control of several functions and other operational attributes of the printer 10 (which will be discussed in further detail hereinafter) is made integral with a front surface of housing 14 in the depicted embodiment.

A right side wall of housing 14 defines a media or substrate intake area 18. A wire form 20 is attached thereto and an intake aperture is formed therein (not shown). A suitable continuous form substrate or media 22 is taken from a media supply 24 provided adjacent the printer. Media 22 is applied across the wire form 20 and into the printer 10 for processing. Although illustrated as a box in FIG. 1, media supply 24 can comprise other configurations, such as a supply wheel or roll, for example.

A left side wall of housing 14 defines a media exhaust or outfeed area 26. A second wire form (not shown) is ideally attached to the left sidewall in the media exhaust area 26. The second wire form is operable to direct the processed substrate or media 22 to a downstream refolding area.

Figure 2:
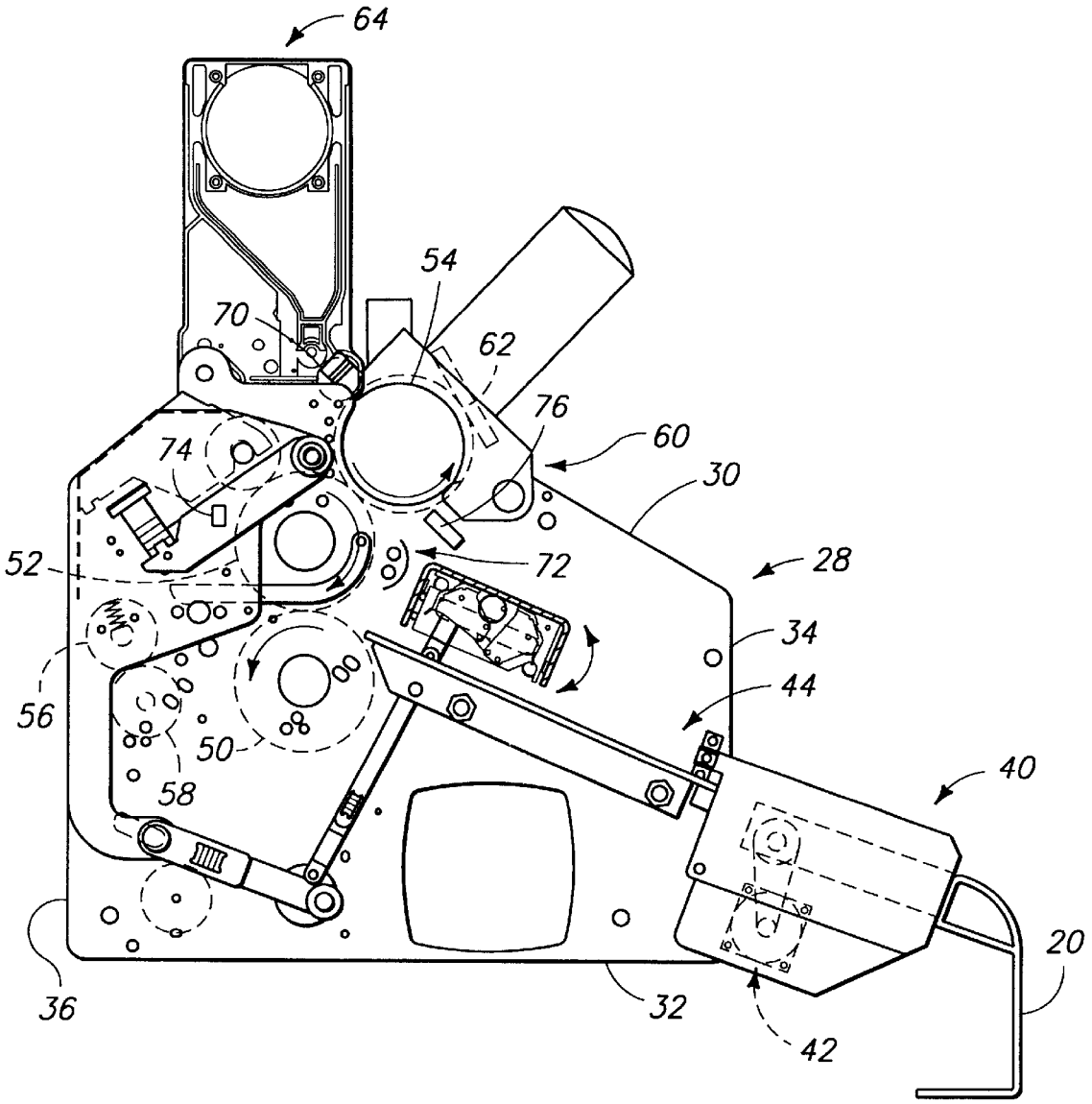
FIG. 2 is a cross-sectional view of the printer from an operator side thereof taken along line 2—2 of FIG. 1.

Referring now to FIG. 2, housing 14 defines a cavity and encloses a frame which is generally indicated by numeral 28. The frame 28 has two discreet sections only one of which is shown in the drawings. It is to be understood that the opposite section of the frame, which is spaced therefrom, will be substantially a mirror image of the same. The frame 28 has a top peripheral edge 30, a bottom peripheral edge 32 which rests on the base portion 12, a right peripheral edge 34, and a left peripheral edge 36.

Still referring to FIG. 2, various assemblies of the printer 10 are shown and described hereafter in detail. A media propulsion assembly 40 is provided adjacent the intake area of housing 14 and right peripheral edge 34 of frame 28. Media propulsion assembly 40 is mounted with frame 28 and properly aligned with wire form 20 to receive continuous form media guided thereby. Media propulsion assembly 40 includes a motor 42 for powering tractors operable to provide the media 22 into printer 10.

The illustrated printer 10 additionally includes a media or substrate engagement assembly 44 secured upon the frame 40. Media engagement assembly 44 is located adjacent and downstream of media propulsion assembly 40. The media engagement assembly 44, as a general matter, is operable to direct the continuous substrate or media 22 along a given path of travel substantially defined thereby. In particular, media engagement assembly 44 receives media 22 from the media propulsion assembly 40 and guides the media 22 toward an internal imaging assembly 60 configured to provide the printed images upon the media.

As referred to above, printer 10 of the subject invention includes an imaging assembly 60 to form, print or otherwise provide the desired images upon media 22. The preferred embodiment of the printer 10 according to the present invention utilizes offset printing to provide the image upon media 22. In general, the described embodiment of imaging assembly 60 accepts data corresponding to the image, forms the received data as a latent electrostatic image, develops the image with toner, and offsets the toner image onto printable media 22.

The illustrated imaging assembly 60 comprises a plurality of rotatable drums, a developer 64 and a print cartridge or head 62. The rotatable drums include a first or pressure drum 50, second or transfuser drum 52 and a third or imaging drum 54. The respective first, second, and third drums 50, 52, 54 have engagement areas or nips therebetween which are designated in FIG. 3 as $T_1$ and $T_2$, respectively.

A commercially available print head 62 may be secured from Delphax Systems, Inc. of Mississauga, Ontario, Canada. In particular, one suitable embodiment of print head 62 is described in U.S. Pat. No. 4,891,656 to Kubelik, incorporated herein by reference.

Such a print head is discussed below and configured to provide electron deposition of a latent image. In general, print head 62 is a point charge generating device which comprises a plurality of alternating layers of electrodes and insulators which form a matrix of print points. Such a configuration enables the formation of individual dots anywhere along the media 22 at a resolution of 300 dots by 300 dots per inch (dpi).

The latent image is developed following provision thereof upon imaging drum 54 by print head 62. One embodiment of developing the latent image upon the imaging drum 54 includes applying toner via the developer 64. The "tonerized" image formed upon imaging drum 54 is transferred to transfuser drum 52 and subsequently to media 22. The transferring of the image from the imaging drum 54 to the transfuser drum 52 is permitted in the printing operational mode wherein drums 52, 54 are in contact at imaging (i.e., $T_2$) nip. Media 22 supplied via the media engagement assembly 44 passes between transfuser drum 52 and pressure drum 50 at nip $T_1$. The toner image received upon the outer surface of transfuser drum 52 is transferred to the media 22.

Figure 3:
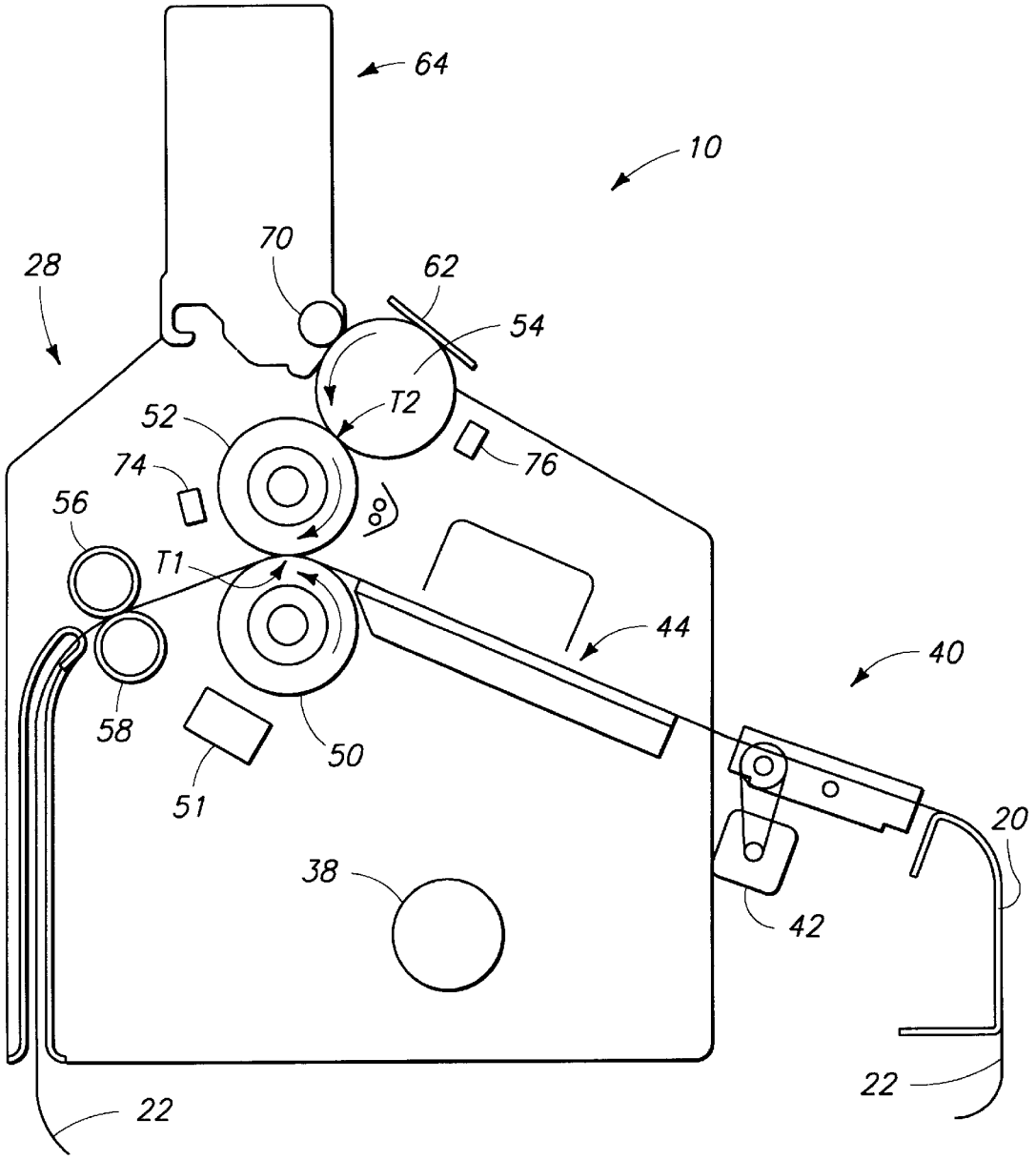
FIG. 3 is a diagrammatic representation of an imaging assembly and a media travel path through the printer.

A pair of pinch or exhaust drums including first outfeed drum 56 and second outfeed drum 58 are mounted in spaced relationship relative to first or pressure drum 50. Following the printing, pinch or outfeed drums 56, 58 receive the printed media 22 and guide the media to the outfeed area 26. Referring to FIG. 3, media propulsion assembly 40, media engagement assembly 44, drums 50, 52 and outfeed drums 56, 58 generally define a media path. Media 22 is shown along the media path within printer 10 in FIG. 3. The path illustrates the path of travel of the continuous form media 22 through printer 10.

Print head 62 works in combination with the third or imaging drum 54 of imaging assembly 60 to electrostatically form a predetermined image thereon. This electrostatic image formed upon the imaging drum 54 may be referred to as a latent image. In one embodiment, imaging drum 54 comprises a hard-coat anodized (dielectric) aluminum cylinder which receives the electrostatic latent image from the print head 62. Exemplary electrostatic images include electrographic and electrophotographic images. Other images are possible.

A rotary tachometer is provided axially adjacent imaging drum 54 to provide rotational information thereof. In the described embodiment of printer 10, the rotary tachometer contains an infrared sensor configured to provide a resolution of 87.38 counts per lineal inch about the circumference of imaging drum 54. Such rotational information of imaging drum 54 is utilized to synthesize image resolution for positioning the latent image upon the imaging drum 54. Utilization of rotational information of imaging drum 54 permits variable speed printing. Further details regarding variable resolution imaging of the latent image upon imaging drum 54 are described below.

Toner dispensing assembly or developer 64 is provided adjacent the outer surface of imaging drum 54. Developer 64 is configured to selectively deliver toner to drum 54 following the provision of the latent image upon the outer surface thereof. Providing toner to imaging drum 54 having the latent image thereon develops the image for subsequent offsetting of the image to the media 22. Developer 64 includes a toner roller 70 operable to apply toner to image roller 54. The latent image upon the imaging drum 54 becomes a "tonerized" or developed image following the transfer of toner. As the imaging drum 54 rotates as indicated in FIG. 2, particles of toner are attracted to the latent image formed upon imaging drum 54. The outer surface of imaging drum 54 picks up toner from the developer 64 as defined by the formed latent image thereon. The developed image is next transferred to transfuser drum 52.

In an exemplary embodiment, transfuser drum 52 comprises an aluminum cylinder core with a high-release silicone rubber coating for receiving and transferring the developed toner image. Transfuser drum 52 is maintained at a temperature greater than imaging drum 54 to facilitate the transferring of toner as described in detail in a U.S. patent application entitled "Continuous Form Printers and Methods of Forming Images Upon Media," naming John D. Gillen as inventor, filed the same day as the present application, assigned to the assignee hereof, having application Ser. No. 08/991,316, filed Dec. 16, 1997, and incorporated herein by reference.

Housing 14 provides imaging drum 54 and transfuser drum 52 in a contacting relationship when printer 14 is provided in an operational printing mode to effect the transfer of the developed image. Transfuser drum 52 is supported and movable by a movable lifting member and is selectively placed into contact with the first or pressure drum 50.

Transfuser drum 52 operates to offset the developed image to the media 22. Media 22 passes through pressure drum 50 and transfuser drum 52. Such passage of media 22 through drums 50, 52 provides the image onto media 22. Surface energy of media 22 tends to be higher than that of the silicone-rubber transfuser drum 52. In addition, special release agents such as silicone oil assist with the offsetting of the toner image from transfuser drum 52 to media 22. Further, the low viscosity of the toner and the preheating of certain types of media allow the toner to penetrate or "wick" into the media at the pressure nip (i.e., $T_1$ nip).

Figure 4:
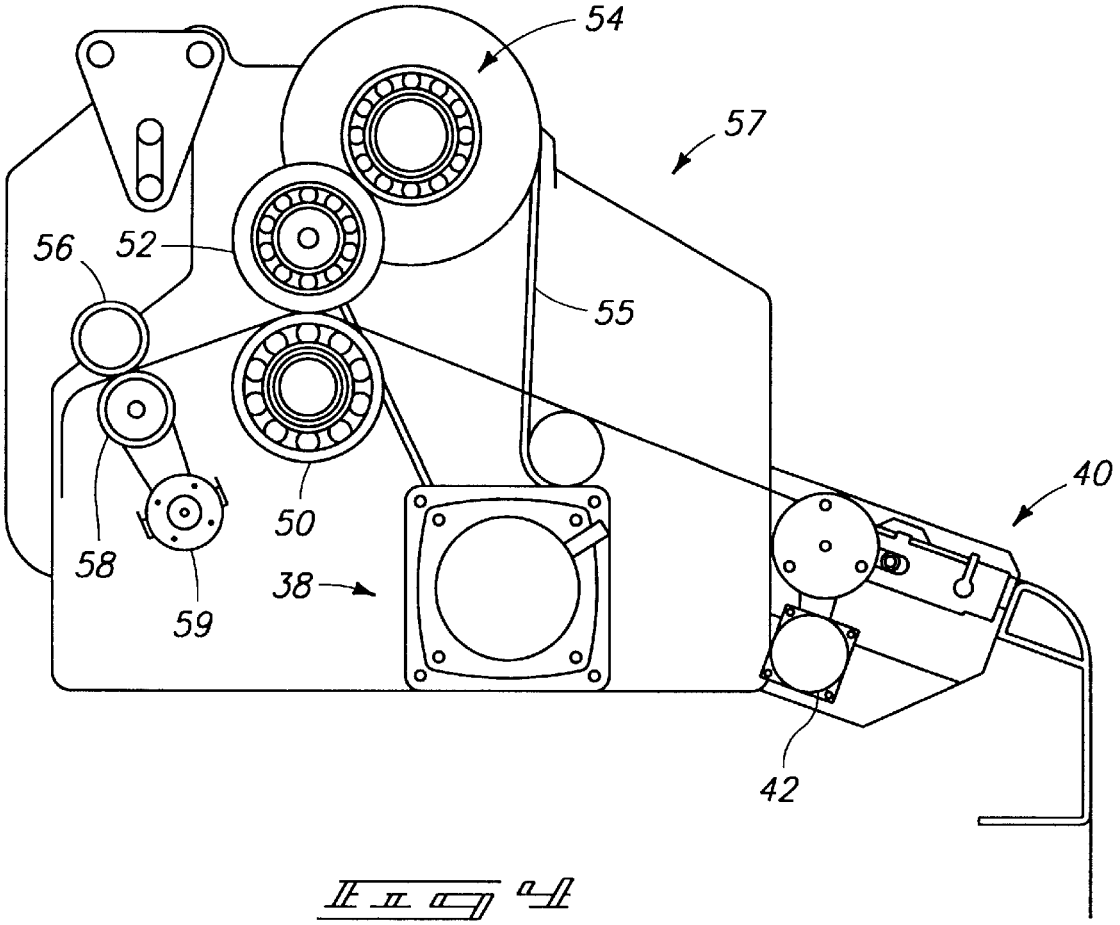
FIG. 4 is a diagrammatic representation of one embodiment of a drive system of the printer.

Following the formation of the images, the printed media 22 is guided to exhaust outfeed drums 56, 58 and outfeed area 26 of printer 10 following provision of the images thereon. Outfeed drums 56, 58 are configured to provide approximately a 5 lb. load on the media 22 as the media leaves the pressure nip. As shown in FIG. 4, an outfeed motor 59 is configured to drive outfeed drum 58.

Still referring to FIG. 4, an embodiment of a drive assembly 57 of the printer 10 is shown. The depicted drive assembly 57 includes a main drive motor 38 and a drive belt 55. In the described embodiment of printer 10, individual drums 50, 52, 54 are driven from main drive motor 38 and drive belt 55. Drive belt 55 engages the imaging drum 54. In particular, main drive motor 38 drives imaging drum 54 which in turn drives transfuser drum 52 which in turn drives pressure drum 50. The individual drums of imaging assembly 60 rotate in the direction as illustrated in FIG. 2.

In addition to the foregoing, pressure drum 50, transfuser drum 52 and imaging drum 54 of imaging assembly 60 are maintained within predefined temperature ranges to optimize printing upon media 22. Such temperature ranges are maintained by heating or cooling devices during printing operations and selected standby operations. As described below, maintaining the imaging assembly drums 50, 52, 54 within the specified temperature ranges facilitates the printing process and transfer of toner.

Inasmuch as the illustrated embodiment of printer 10 is configured for offset printing, it is preferred to maximize the toner transferring capabilities of the imaging assembly 60 and especially the imaging drum 54 and transfuser drum 52 thereof. The print quality depends upon the ability of the imaging drum 54 and transfuser drum 52 to transfer the generated image to the media 22. Temperature conditioning of the toner aids with the transferring of toner from the imaging drum 54 to transfuser drum 52. To maximize the transfer of toner from imaging drum 54 to transfuser drum 52, the temperatures of the two drums are regulated to "discourage" the gripping of toner via the imaging drum 54 and "encourage" the gripping of toner via the transfuser drum 52.

Surface materials of the imaging drum 54 and transfuser drum 52 additionally play an important role in maximizing the transfer of toner. In particular, the surface of imaging drum 54 is a relatively smooth hard anodized surface compared with the soft, rougher, silicone rubber surface of the transfuser drum 52. Thus, transfuser drum 52 has a tendency to "grip" and pull the toner from imaging drum 54.

Transfuser drum 52 is preferably provided at a temperature above 110° C. to provide sufficiently tacky toner at the pressure ($T_2$) nip. Transfuser drum 54 is also ideally provided at a temperature less than 130° C. to prevent premature provision of toner in a viscous state. Temperatures in excess of 130° C. result in a degradation of the toner image when the image is fused onto the media 22. More specifically, transfuser drum 52 is maintained in a predefined temperature range, such as 115° C.–125° C. Ideally, transfuser drum 52 is maintained at a temperature of approximately 120° C. This heat energy melts toner which adheres to the transfuser drum 52 thereby reducing it to a tar-like consistency. Such melting of the toner improves the transfer thereof from imaging drum 54 to transfuser drum 52.

The temperature of imaging drum 54 is kept cooler than the transfuser drum 52 to retain the crystalline state of the toner at the toner/imaging drum interface. Ideally, imaging drum 54 is maintained at a temperature of less than about 70° C. However, imaging drum 54 is preferably maintained above a temperature of 55° C. to prevent or minimize the formation of condensation upon the outer surface of the imaging drum 54. More specifically, imaging drum 54 is maintained within a predefined range of approximately 55° C.–65° C., and ideally maintained at the target temperature of approximately 60° C. which is above ambient temperature and below the fusing temperature when the toner is applied to the media 22. Imaging drum 54 is ideally heated prior to printing (e.g., when printer 10 is in stand-by mode) and cooled during printing to maintain the temperature of the drum within the specified temperature range.

Pressure drum 50 is maintained at a temperature of less than about 90° C. Maintaining pressure drum 50 below 90° C. allows drum 50 to draw some of the heat from transfuser drum 52 at the pressure nip thereby reconditioning transfuser drum 52 for the image-to-transfuser offset.

Temperature sensors 74, 76 shown in FIG. 3 are individually mounted in heat sensing relation relative to the respective transfuser and imaging drums 52 and 54. The temperature sensors 74, 76 are utilized to provide temperature information enabling temperature control of respective drums 52, 54. Assemblies to maintain such operational temperatures are provided in heat transferring, or cooling, relation relative to the respective drums.

A pressure drum fan 51 is provided adjacent pressure drum 50 as shown in FIG. 3. Pressure drum fan 51 is configured to cool pressure drum 50. Cooling pressure drum 50 allows the drum to draw some of the heat from transfuser drum 52 at the pressure nip.

The printer 10 according to the present invention includes a control assembly for supervising and controlling the operation of printer 10. The control assembly operates various printer functions. For example, the control assembly coordinates the speeds of rotation of the drums of the imaging assembly, and controls the media intake assembly and temperatures of the drums of the imaging assembly in order to facilitate the operation of the printer 10.

Figure 5:
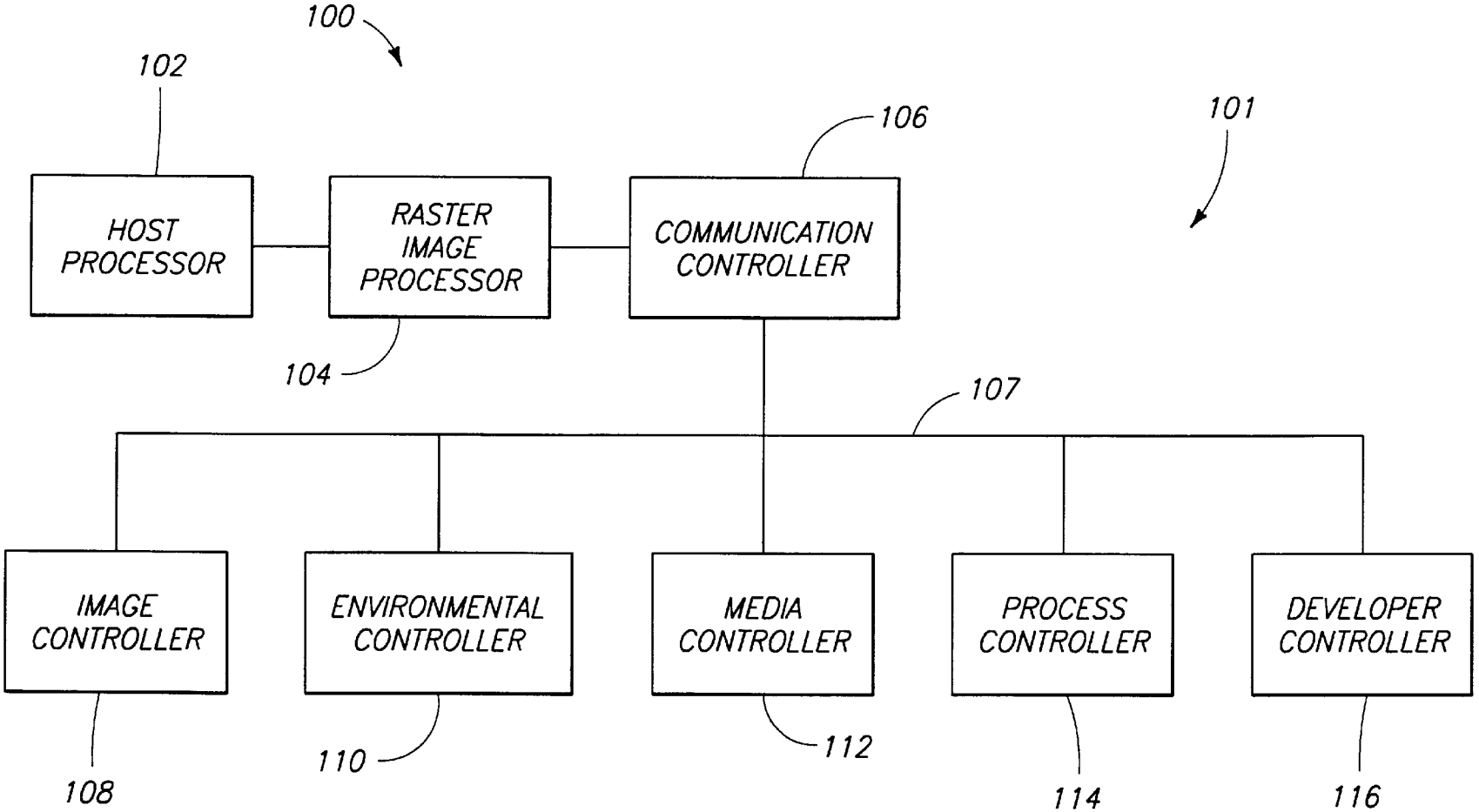
FIG. 5 is a functional block diagram of one embodiment of a control assembly of the printer.
Figure 16:
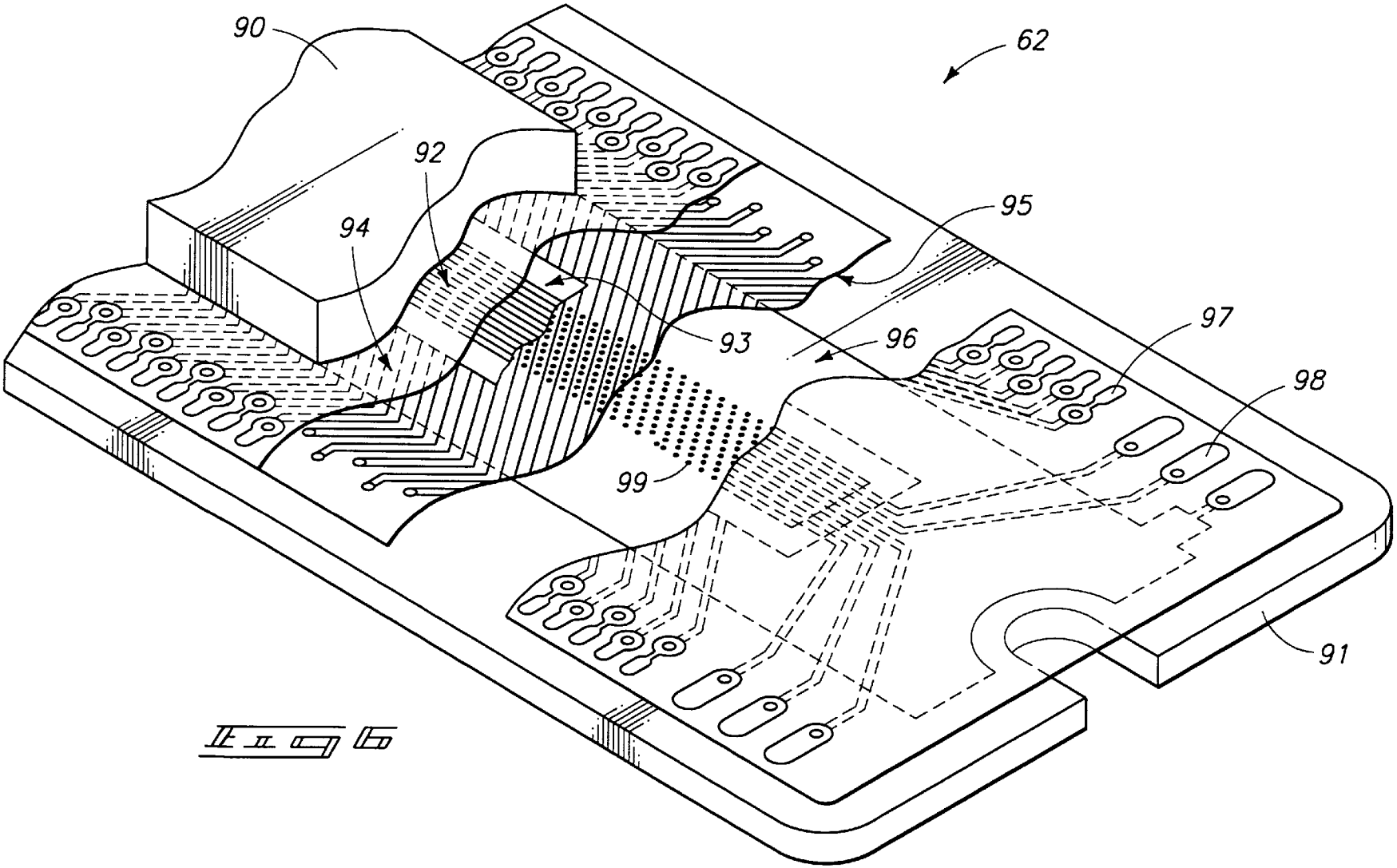
Figure 11:
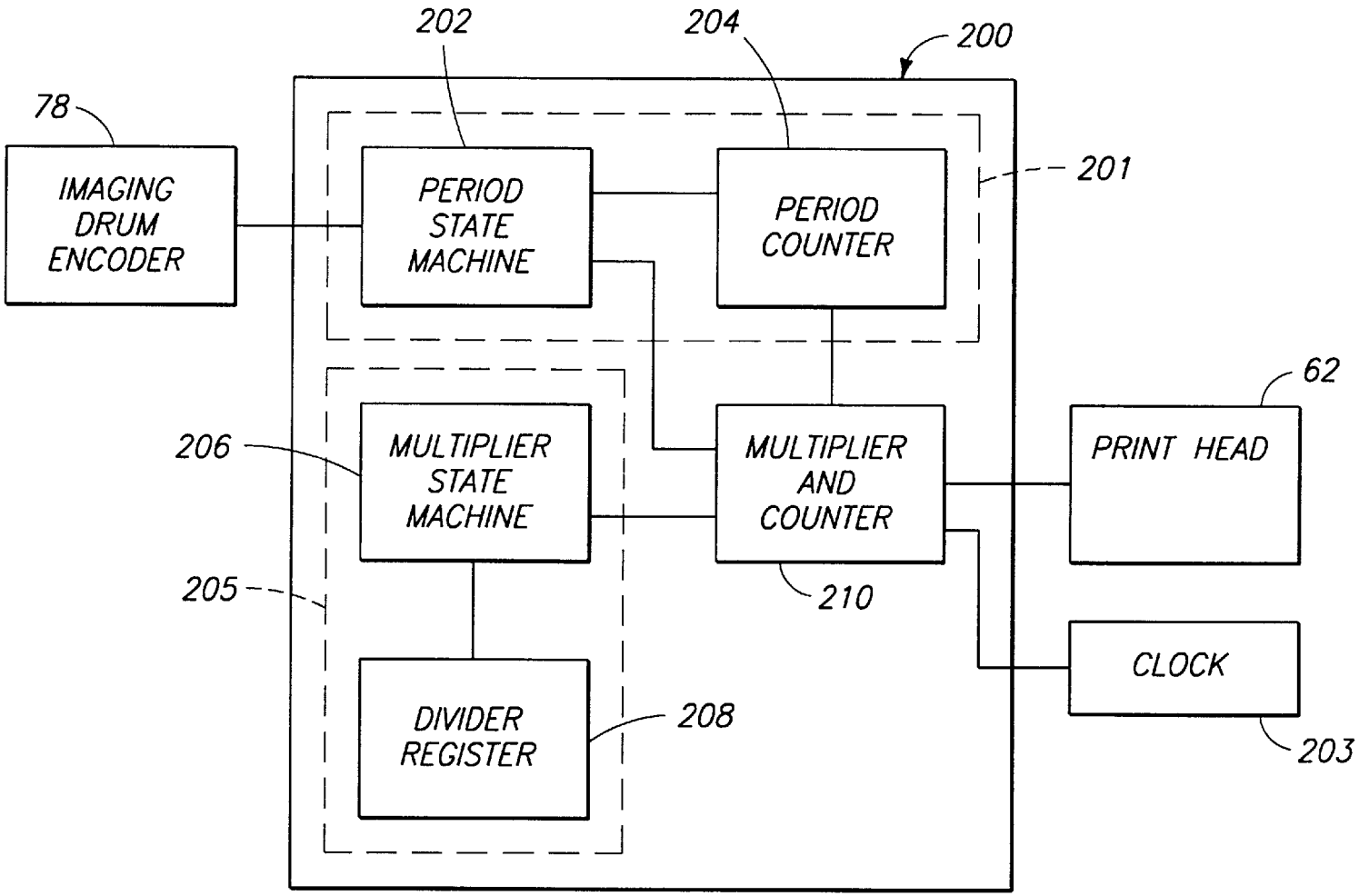
Figure 88:
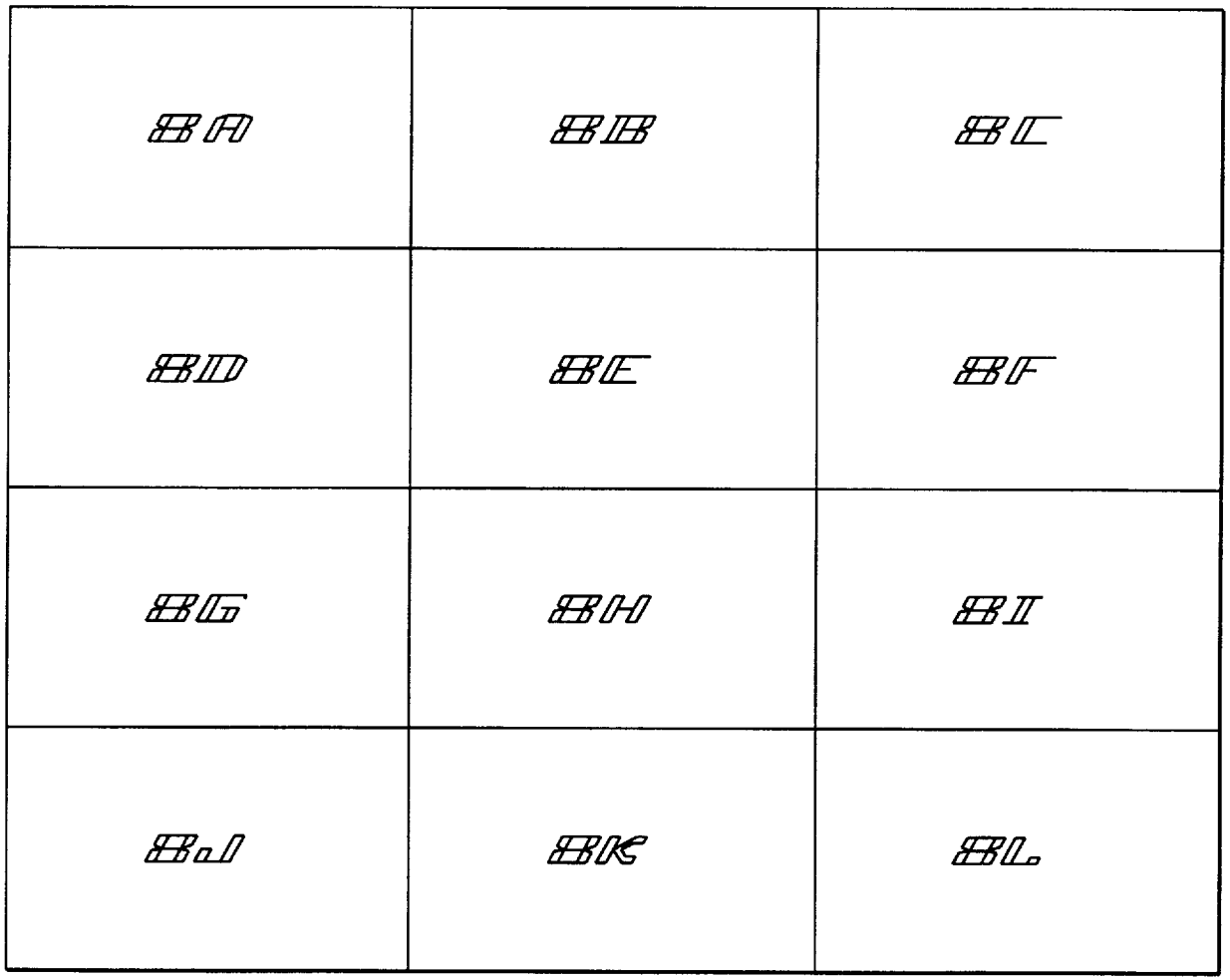

Referring now to FIG. 5, one embodiment of control assembly 100 is described below. The described embodiment of control assembly 100 of printer 10 includes an internal network 101. The internal network 101 operates as a serial master/slave multi-drop network in one embodiment of the invention.

The illustrated internal network 101 comprises a communication controller 106, which is connected via a data line 107 to a plurality of controllers. Such controllers include an image controller 108, environmental controller 110, media controller 112, process controller 114, and a developer controller 116. Additionally, communication controller 106 is coupled with a raster image processor (RIP) 104 within printer 10. Raster image processor 104 receives image data from a host processor 102.

The controllers 106–116 comprise 8051 processors provided by Intel Corporation of Santa Clara, Calif., in accordance with one embodiment of the present invention. In the described embodiment, raster image processor 104 comprises a 960H processor also provided by Intel Corporation. Other microprocessors are utilized in other embodiments of the invention. The processors individually include an internal ROM which is configured to store operational and communications code.

Operational code includes commands for operating associated printer components coupled with the individual processor. Communications code enables the individual processor to communicate with other processors of the control assembly 100 via communications network 101.

In the described embodiment, the individual controllers are electrically coupled with various components of the printer 10. More specifically, image controller 108 is coupled with print head 62 and an image drum tachometer. Environmental controller 110 is coupled with the heating and cooling assemblies. Media controller 112 is coupled with drive motor 38, media propulsion motor 42, and exhaust or outfeed motor 59. Further, media controller 112 is coupled with a media tachometer of media propulsion assembly 40 for monitoring the position and velocity of media 22 through printer 10.

Process controller 114 is coupled with accessories. For example, process controller 114 may be utilized to control supply and take-up rolls (not shown) for media 22. Developer controller 116 is coupled with developer 64. In particular, developer controller 116 is operable to control developer roller 70 for controlling the supply of toner to imaging drum 54.

During print operations, host processor 102 supplies a first description, such as a page description, of either a single image or a plurality of images to raster image processor 104. Raster image processor 104 of printer 10 is configured to receive image data from the host processor 102 via either a serial, parallel or I/O input interface.

Raster image processor 104 converts the images from the first description to a second description, such as a bit map of the image. Such conversion operations are referred to as rasterization of the incoming data images. Once a received image has been rasterized, raster image processor 104 sends a print request command to communication controller 106. Communication controller 106 recognizes the first print request and instructs the media controller 112 and image controller 108 to begin print operations.

Media controller 112 provides the media 22 in position for printing through the utilization of media propulsion assembly 40. Media controller 112 is also configured to monitor and provide position information of media (e.g., top of form positioning of individual forms of continuous form media 22). Media controller 112 outputs a top of form (also referred to as TOF) indication corresponding to the proper top of form positioning of a sheet of media 22. Media controller 112 closes the $T_1$ nip upon the media 22 to begin the print process. Additionally, media controller 112 is operable to open the $T_1$ nip to disconnect transfuser drum 52 from media 22 at the end of a print job.

Image controller 108 waits for a top of form indication from media controller 112 to begin imaging. Image controller 108 interfaces with raster image processor 104 via communication controller 106 during printing. Image controller 108 is also coupled with a tachometer or encoder (shown in FIG. 7) upon imaging drum 54. The tachometer provides rotational velocity and position information of imaging drum 54. Such imaging drum information may be utilized by image controller 108 and imaging assembly 60 during printing. Inasmuch as the media velocity, also referred to as print velocity, of printer 10 is variable, the formation of images via print head 62 is dependent upon the rotational velocity of imaging drum 54.

One embodiment of image controller 108 provides a data arranger. In general, the data arranger is configured to provide image data from the raster image processor 104 into a memory device such as a Video DRAM. The image data is outputted from the memory device to print head 62.

Once all data from the raster image processor 104 has been provided to image controller 108 and imaging has been completed, image controller 108 forwards an image stop command to communication controller 106 to finish printing. Alternatively, image controller 108 indicates an image stop command if raster image processor 104 is unable to keep up with the printing upon media 22. In the preferred embodiment, raster image processor 104 must complete the conversion from the first description of the next image to be imaged to the second description of the next image before print head 62 has imaged the last 25 scan lines of the image currently being imaged upon imaging drum 54. Image controller 108 issues an image stop command if controller 108 fails to receive the print ready command from raster image processor 104 before the imaging of the final 25 scan lines.

Printer 10 is configured to operate at a variety of print speeds. Such variable speed printing operations upon media 22 within printer 10 are discussed with reference to copending U.S. patent application entitled "Continuous Form Printers and Methods of Forming Images Upon Media," incorporated by reference above.

Print head 62 creates an electrostatic image by directly depositing charge onto the dielectric surface of imaging drum 54 from electron charged plasma created in holes within print head 62. The electrostatic images is provided upon imaging drum 54 responsive to the rotational velocity information of the drum 54 provided by the imaging drum tachometer.

Referring to FIG. 6, one embodiment of print head 62 is shown. More specifically, the depicted print head 62 is a multi-layer assembly of plural drive or RF lines 92, a mica dielectric 93, plural finger electrodes 94, an insulator layer 95 and a screen element 96. Print head 62 also comprises a lower support surface 91 defining a plurality of holes or apertures 99 corresponding to the dots for forming the latent images. A stiffener 90 is provided along the upper surface of print head 62 for structural integrity.

The drive lines 92 lie parallel to the axis of the imaging drum 54. In one embodiment of the invention, print head 62 comprises eleven parallel drive lines 92, which are spaced approximately 4 dots apart at the print resolution desired, such as 300 dpi. During operation of print head 62, high voltage, high frequency A/C is applied to the drive lines 92 via contacts 98 to ionize the air molecules in the holes 99 of print head 62 defined by lower surface 91. Such ionization creates a charged plasma between the surface of the mica insulator 93 and the screen 96. The screen 96 and RF finger electrodes 94 are DC biased at approximately −650 volts. Electrons generated are accelerated toward the imaging drum 54 and ejected through the respective print holes 99 within lower surface 91. The finger electrodes 94 are preferably held at either −650 volts to assist the charge ejection or at about −450 volts to inhibit such ejection. Two hundred thirty-six (236) finger electrodes 94 are provided in the described embodiment of print head 62. Such finger electrodes 94 are coupled with respective contacts 97 and are placed at approximately 60° angles to the RF drive lines 92.

RF drive lines 92 are sequentially selected or scanned responsive to drive signals to generate dots of a single line. By multiplexing the RF line charge generation and the finger electrode gating, all charge generation sites or dots can be selectively operated. The RF drive lines 92 are physically spaced at approximately four print lines apart from other RF lines in the described embodiment of print head 62. Thus, it takes 44 lines for the print head 62 to completely deposit all the charge for one complete scan line. The RF drive lines 92 are sequentially energized every line position. Further operations of an embodiment of print head 62 are described in detail in the '656 patent incorporated by reference above.

In the described embodiment, the RF drive line multiplexing is locked to the velocity of the surface of imaging drum 54. The firing of RF drive lines 92 of print head 62 is responsive to the rotational position of imaging drum 54. It is desired to space RF line fires in the print head 62 evenly over each line period. Printer 10 is configured to generate a reference signal providing appropriate firing of the RF lines of print head 62.

In one embodiment, imaging drum 54 is coupled with an encoder or tachometer for providing a first reference signal corresponding to the rotational position of imaging drum 54. Preferably, the first reference signal is converted to a second reference signal via a preselected conversion operator or ratio. In one embodiment, conversion operations are provided by a tachometer synthesizer discussed below.

Such signals are converted prior to the application thereof to print head 62 for timing the firing of the RF lines 92. Such conversion of the imaging drum rotational position reference signals enables variable resolution of the formed images. The first reference signal provides one resolution. By varying the conversion operator, plural resolutions are attainable as discussed in detail below. Enabling printing at a variety of print resolutions permits correction of the "creep" printing phenomenon.

A plurality of second reference signals, also referred to herein as firing, drive or RFTACH signals, are generated responsive to each first reference signal. The first reference signal is also referred to as a DRUMTACH signal and is the output signal of the imaging drum encoder. The DRUMTACH signal provides the resolution of imaging drum 54. The number of RF drive signals is equal to the number of RF drive lines 92 according to one embodiment of the present invention. The drive signals are utilized to sequentially fire the RF lines 92 thereby forming a latent image. The drive signals fire the RF drive lines 92 to provide imaging at a target resolution to compensate for creep within printer 10.

Referring to FIG. 7, one method for providing generating and applying the RF drive lines within printer 10 is described. Firing of RF lines of print head 62 preferably corresponds to the rotational velocity of imaging drum 54 being above a predetermined threshold to provide printing within the dynamic range of the imaging drum encoder and an acceptable quantization error range. Thus, printer 10 is preferably configured to indicate when the rotational velocity of imaging drum 54 is above a predetermined threshold. As described below, a TACHVALID signal indicates rotation of imaging drum 54 above the threshold.

In one embodiment of the invention, a tachometer synthesizer 200 is provided to implement reference signal conversion operations and monitor the rotational speed of imaging drum 54. Tachometer synthesizer 200 is provided within image controller 108 of printer 10 in the described embodiment of the invention. More specifically, tachometer synthesizer 200 is provided within a data arranger of image controller 108. As shown in FIG. 7, tachometer synthesizer 200 is operably coupled with an imaging drum encoder 78 and print head 62.

Imaging drum encoder 78 outputs the first reference or DRUMTACH signal. The first reference signal provides resolution rotational information of imaging drum 54. In one embodiment, imaging drum encoder 78 provides the first reference signal at a resolution of approximately 1080 counts/rev or approximately 87.38 counts/inch.

The first reference signal is applied by imaging drum encoder 78 to tachometer synthesizer 200. Tachometer synthesizer 200 is configured to convert the first reference signal (DRUMTACH) to the second reference signals (RFTACH) for firing the RF lines 92. The RFTACH signals are utilized to space the firing of RF lines 92 in print head 62 evenly over each line period.

Tachometer synthesizer 200 also generates a LINETACH signal which provides the correct frequency locked conversion between the physical rotation of imaging drum 54 and the desired image line spacing at a nominal exemplary resolution of 300 dpi. The LINETACH signal synchronizes the start of each scan line within the image controller 108. The RF drive signal has a frequency eleven (corresponding to the number of RF lines 92 in print head 62) times the LINETACH frequency in the described embodiment.

The design of tachometer synthesizer 200 permits the ratio between the input DRUMTACH signal and the output RFTACH and LINETACH signals to be adjusted over a small range. Such adjustment results in a print resolution adjustment (e.g., 240–350 dpi) to correct creep within the printing process.

One embodiment of tachometer synthesizer 200 is configured to provide three general functions. First, synthesizer 200 provides a period measurement system 201 configured to determine the period of the incoming DRUMTACH signal. Period measurement system 201 is implemented in a period state machine 202 and period counter 204 in the described embodiment of synthesizer 200. Second, synthesizer 200 includes a digital multiplier 205 comprising a multiplier state machine 206 and divider register 208 in the illustrated embodiment. Digital multiplier 205 is configured to compute the ratio between the DRUMTACH signal and the RFTACH signal. Third, synthesizer 200 provides a programmable output multiplier and counter 210 configured to generate the RFTACH and LINETACH output signals.

Period measurement system 201 converts the period between rising edges of the incoming DRUMTACH signal from imaging drum encoder 78 into counts of the main system or global clock. The system clock is 35.3 ns (28.322 MHz) in one embodiment of printer 10. Period state machine 202 of system 201 synchronizes with the DRUMTACH rising edge and enables the period counter 204 to start incrementing form zero on each system clock pulse.

Upon acquisition of the next rising edge of the DRUMTACH signal, period state machine 202 generates and applies a TACHSAVE signal to multiplier and counter 210 transferring the contents of period counter 204 to a holding register in multiplier and counter 210. The period counter 204 is then cleared and counting is repeated between rising edges of the DRUMTACH signal. This cycle is continued so long as rising edges of the DRUMTACH signal are detected.

Period counter 204 is configured to overflow corresponding to a predetermined threshold of the period of DRUMTACH. In particular, if no rising edge is detected or if period counter 201 overflows, then a TACHVALID signal will go low signifying that the period of the DRUMTACH signal is above a predetermined threshold or maximum value indicating the speed of imaging drum 54 is too slow. The TACHVALID signal is generated by bit counter 201 in one embodiment responsive to period counter 204 therein overflowing.

This out-of-range TACHVALID signal is applied to communication controller 106 and multiplier and counter 210. The TACHVALID signal may be utilized by printer 10 to establish minimum operational print speeds and for providing safety interlocks. Such interlocks may include, for example, disabling a heating assembly for increasing the temperature of transfuser drum 52.

One embodiment of period counter 204 is comprised of a divide by 11 prescaler and a 15-bit binary counter. The prescaler is used so that the counts of the 15-bit binary counter represent increments of 11 system clock periods corresponding to the number of RF lines 92 of print head 62. Another number of lines may be generated corresponding to the particular print head being utilized. Provision of the prescaler simplifies the creation of the RFTACH signal at the output of synthesizer 200. The RFTACH signal is 11 times the rate of the LINETACH signal, again corresponding to the number of RF lines 92.

Synthesizer 200 multiplies the DRUMTACH signal by a determined ratio to provide the RFTACH signal. The ratio may be varied to provide plural image resolutions depending upon creep and error calculations. Image controller 108 calculates a ratio for utilization in the conversion operations. An image is formed upon imaging drum 54 and media 22 at a resolution corresponding to the determined ratio. Error is calculated following the formation of the image and a new ratio may be determined responsive to the error.

Multiplier and counter 210 functions as a RFTACH and LINETACH signal generator. In general, multiplier and counter 210 multiplies the output of the period counter 204 by the determined ratio. In particular, the output of period counter 204 is first multiplied by a selected multiplier which yields a 27-bit result. A 14-bit shift of the 27-bit result and loading into a programmable 13-bit counter within multiplier and counter 210 provides the divide function.

One method of determining a ratio for utilization in the conversion operations is described hereafter. The most significant bit of the 15-bit binary counter of period counter 204 is an overflow bit (corresponding to the TACHVALID signal) and is not used in the calculations. Thus, the 14-bit counter value represents periods from nearly zero to 6.36 $\mu$s or 157.15 Hz. With a DRUMTACH signal of 87.38 counts per inch, a linear speed of 1.8 inches per second is provided. The maximum rate is determined by the amount of resolution and permissible quantization error desired. Using 16 inches per second as a maximum linear rate, the period count is 1842. This yields an instantaneous quantization error of about 0.05%.

The multiplier and counter 210 receives the 14-bit output from the period counter 204 and multiplies it by the ratio of 87.38 divided by the desired LINETACH resolution. The LINETACH resolution is varied to compensate for creep. At a nominal 300 dpi output, this ratio is 0.2913. In accordance with one embodiment, an integer approach for multiplication is used that has acceptable round off error for the application. The ratio of 0.2913 is changed to a ratio between a selectable binary multiplier and a simple binary divider of 16384. At 300 dpi, the binary multiplier is 4772. The binary multiplier is provided within divider register 208. Varying the binary multiplier varies the ratio and the resultant resolution of the image.

Referring to FIG. 8A–FIG. 8L, one embodiment of multiplier and counter 210 is shown in detail. FIG. 8 represents the organizational layout of FIG. 8A–FIG. 8L. Multiplier and counter 210 is connected with period state machine 202, system clock 203, period counter 204, multiplier state machine 206, print head 62 and network 101.

Various internal components of multiplier and counter 210 are shown in FIG. 8A–FIG. 8L. In particular, multiplier and counter 210 includes a shift register 212, result register 214, serial adder 216, holding register 218, a programmable counter 220 and a postscalar 222.

Multiplier state machine 206 operates multiplier and counter 210. In particular, multiplier state machine 206 utilizes the contents of the 13-bit divider register 208. Multiplier and counter 210 provides a shift and add sequence to compute the output signals (i.e., RFTACH and LINETACH) responsive to the inputted DRUMTACH signal. Multiplier state machine 206 waits for acquisition of the TACHSAVE signal from the period state machine 202 to begin operation. Reception of the TACHSAVE signal indicates that the 13-bit period data is in a holding register 226 of shift register 212 shown in FIGS. 8D and 8G. Holding register 226 along with a supplemental register 228 of multiplier and counter 210 form a 28-bit shift register holding the multiplicand. Holding register 226 is shown in FIG. 8G and supplemental register 228 is shown in FIG. 8D.

The registers of multiplier and counter 210 are initially cleared. Once the TACHSAVE signal occurs multiplier state machine 206 analyzes the value of the least significant bit of the multiplier within divider register 208.

If the least significant bit of the multiplier is zero, multiplier state machine 206 recirculates the contents of both the 28-bit multiplicand shift register 212 and the 27-bit result register 214 by shifting 27 times. The result register 214 is shown in FIGS. 8E and 8H. This shift causes the result register 214 to rotate back to the same point but it causes the multiplicand within the shift register 212 to precess by one bit position (since it has 28 bits).

Figure 8A:
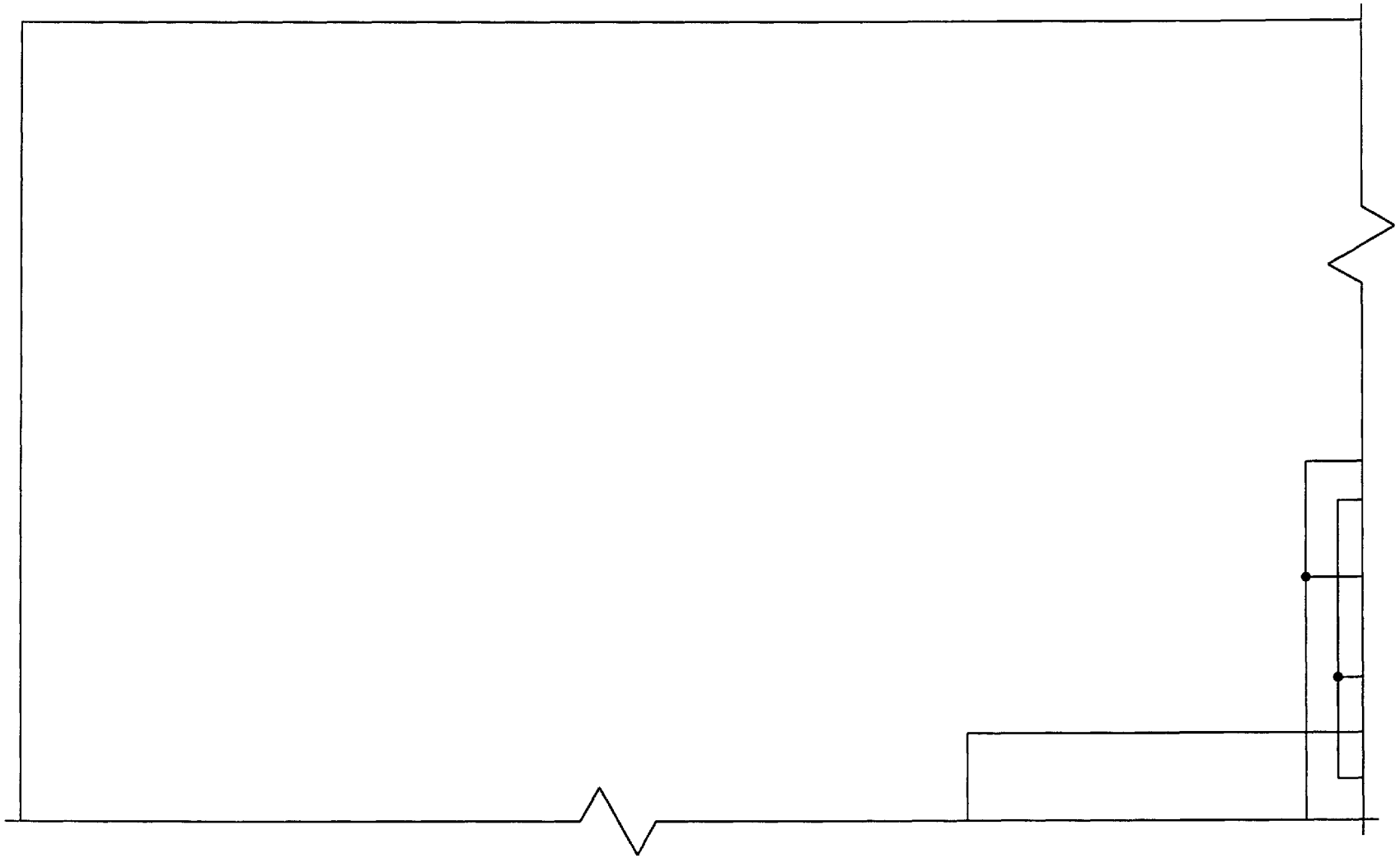
Figure 8B:
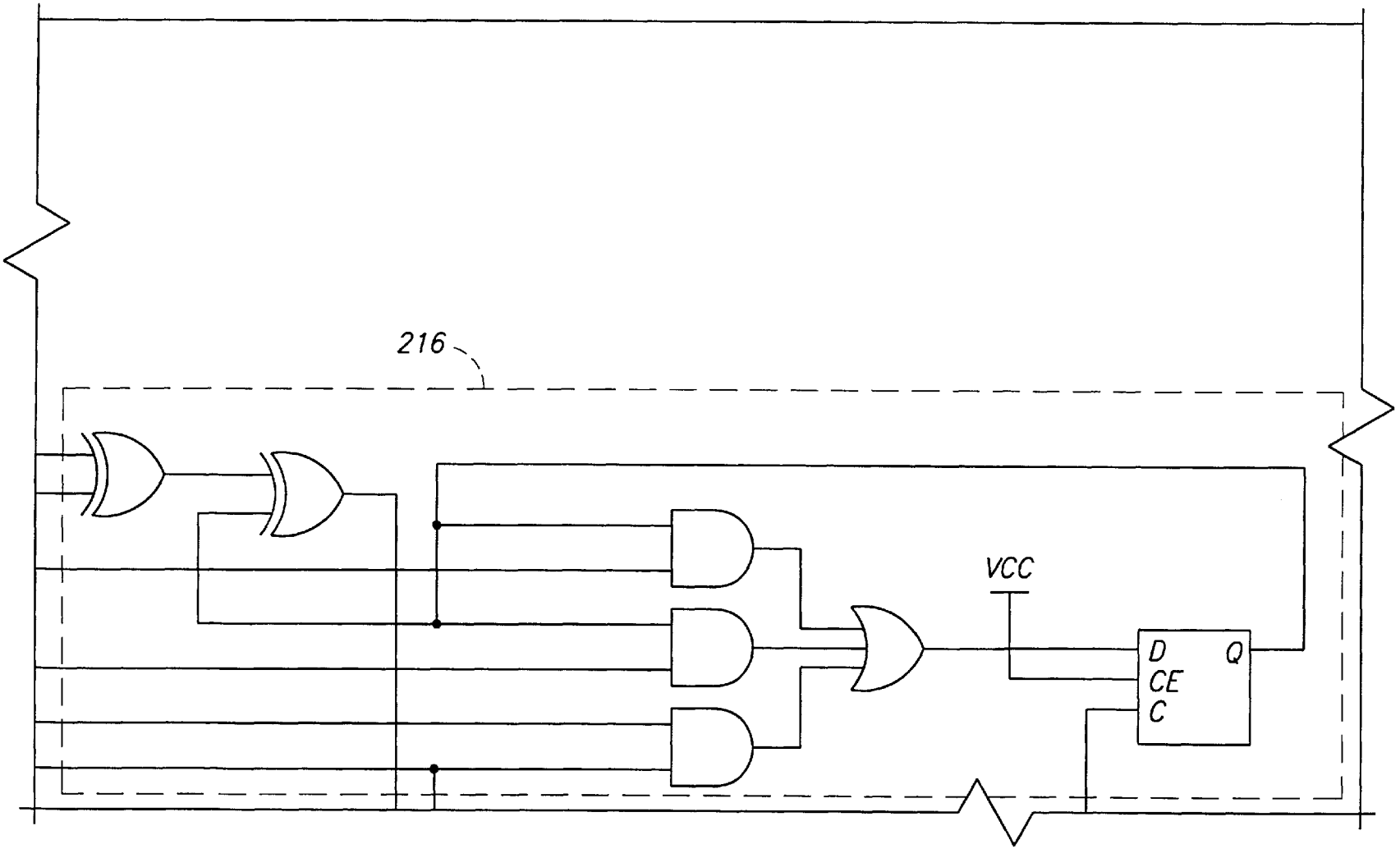
Figure 11:
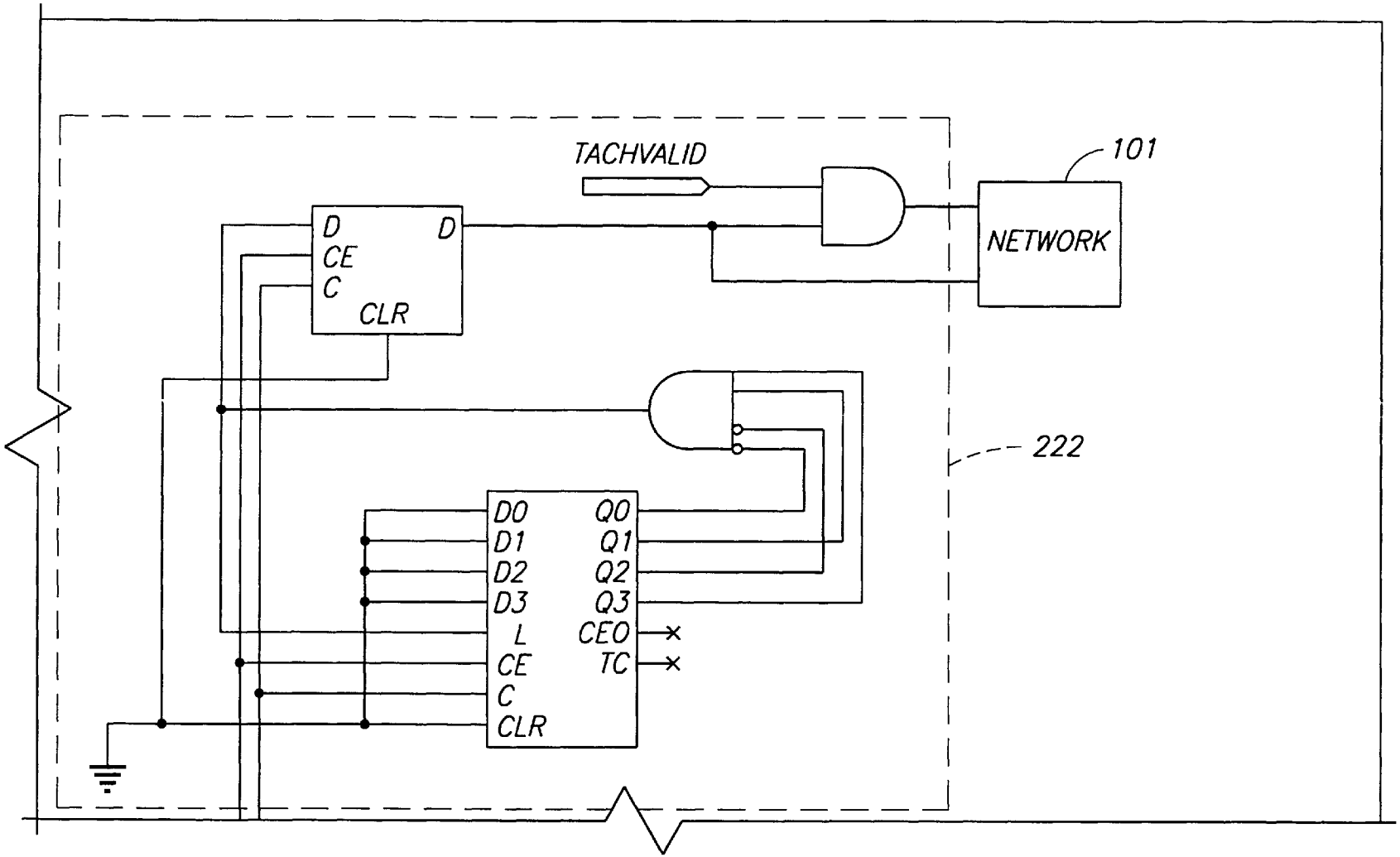
Figure 11B:
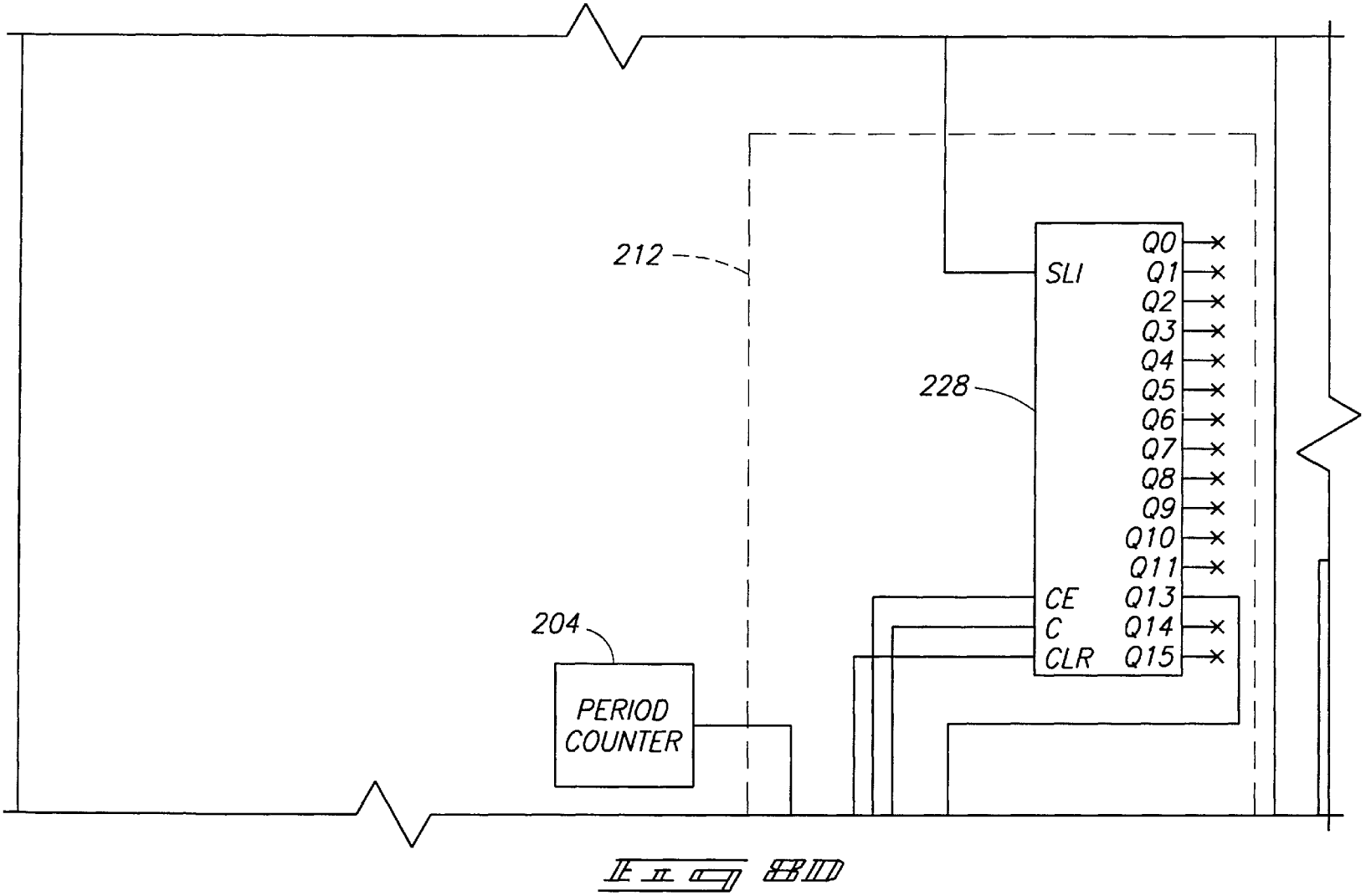
Figure 8E:
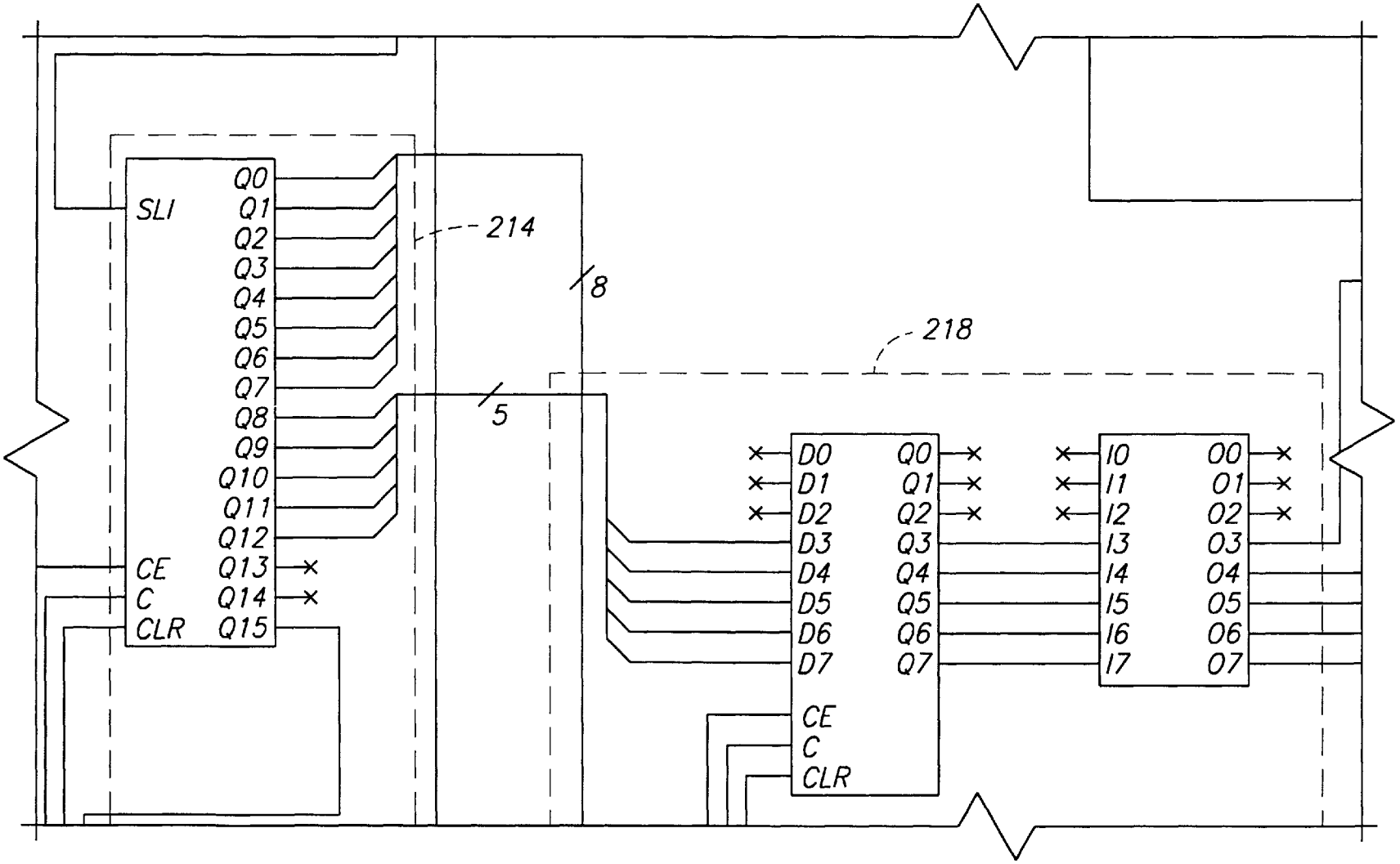
Figure 11F:
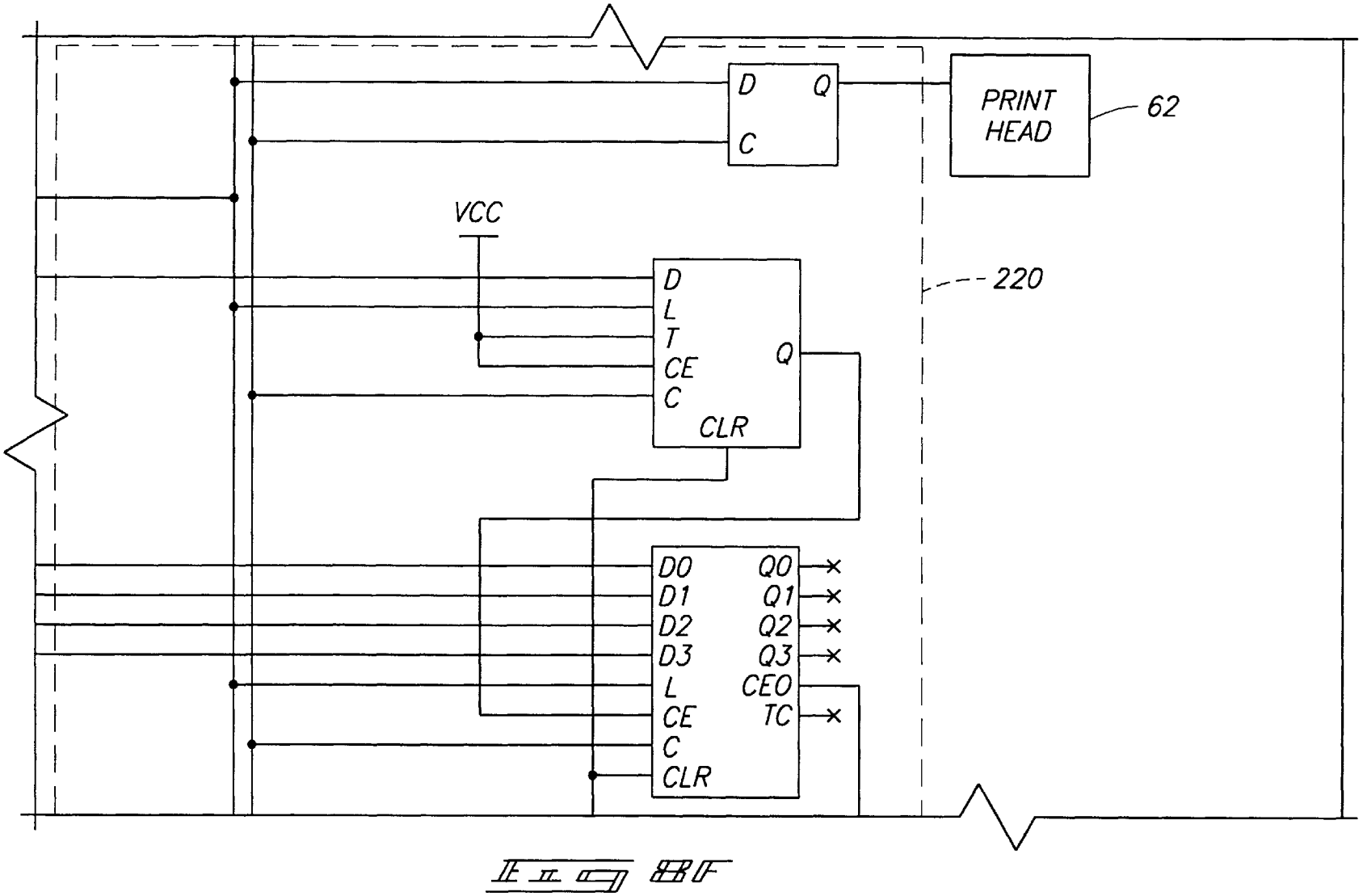
Figure 11:
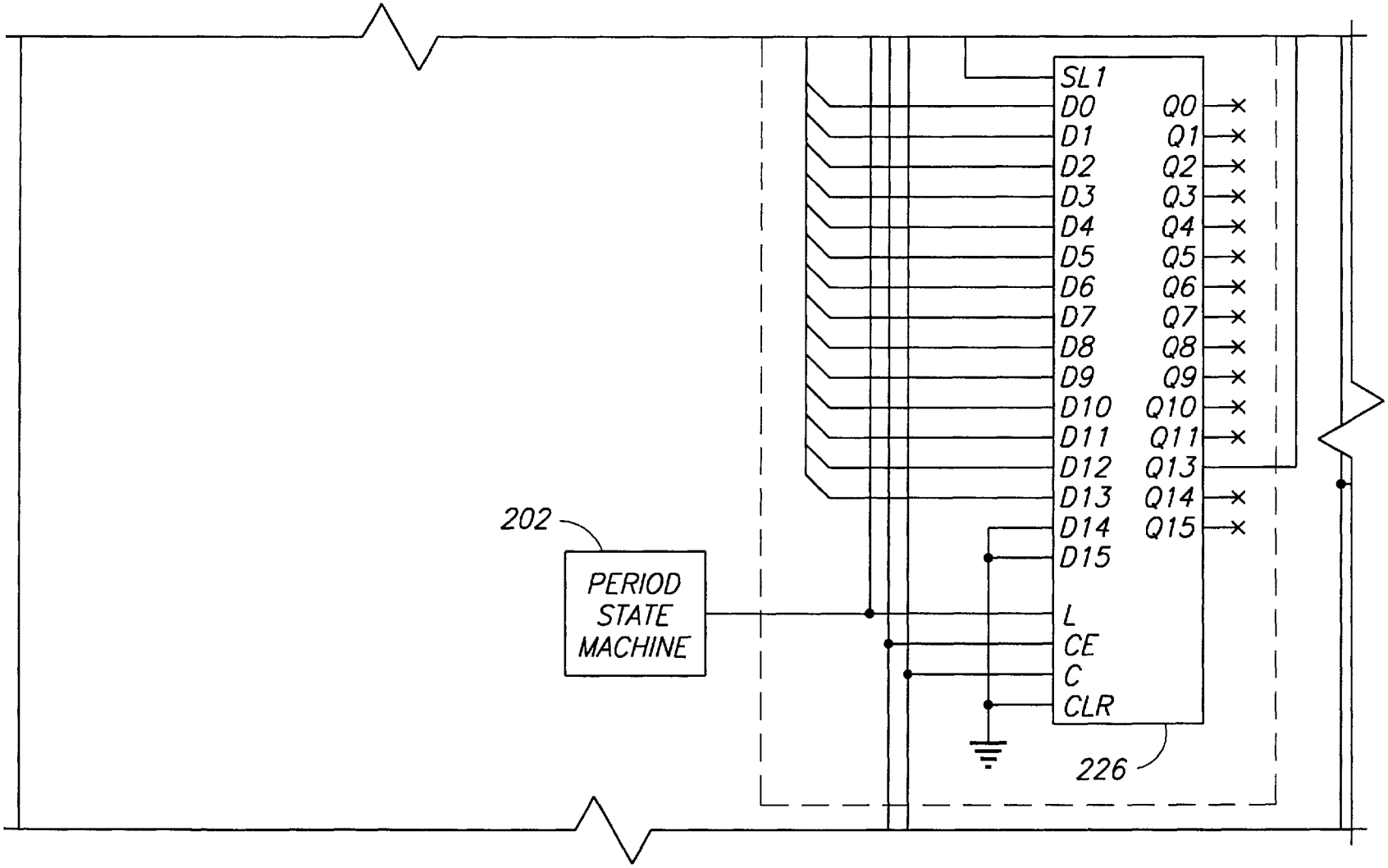
Figure 11B:
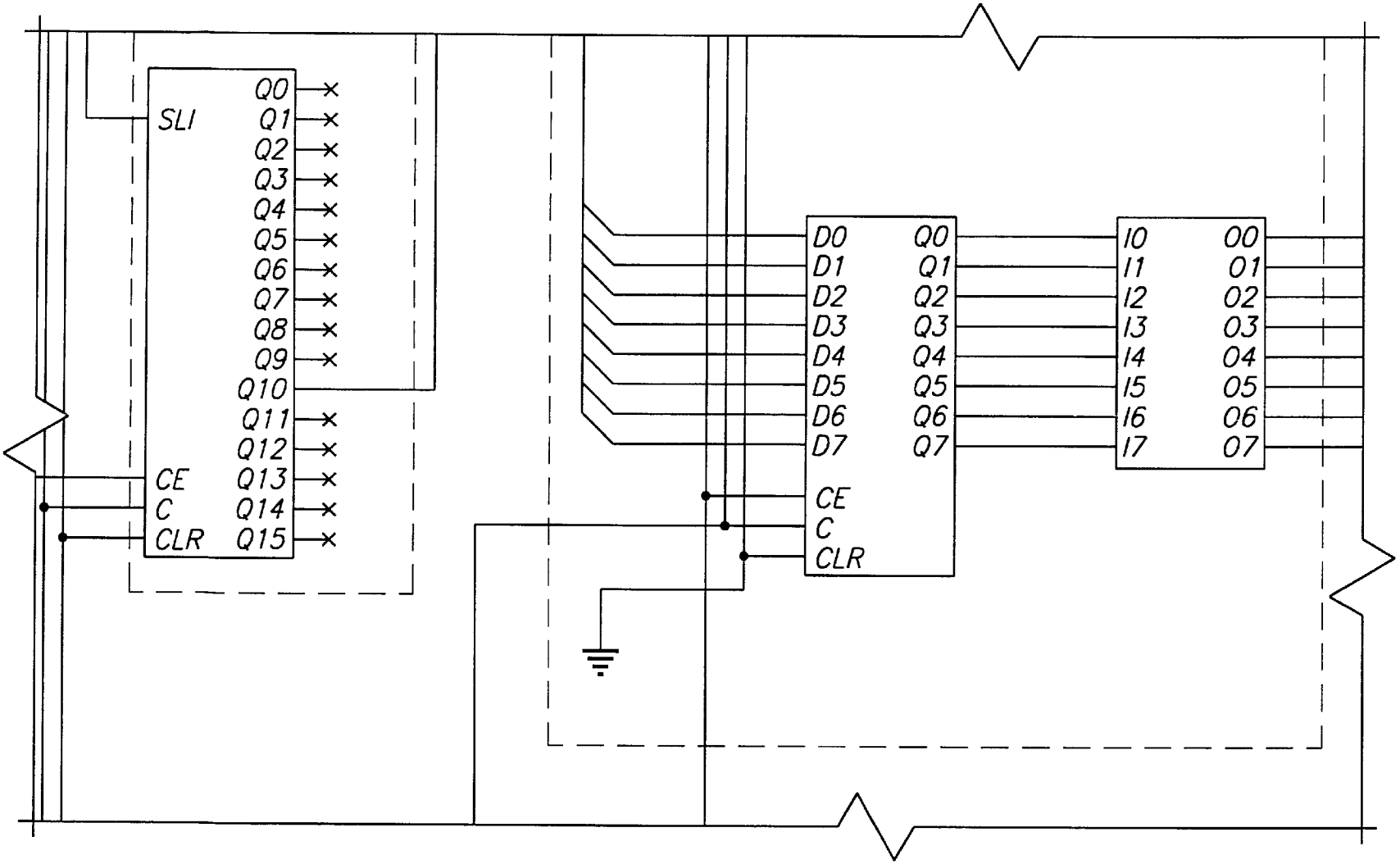
Figure 11:
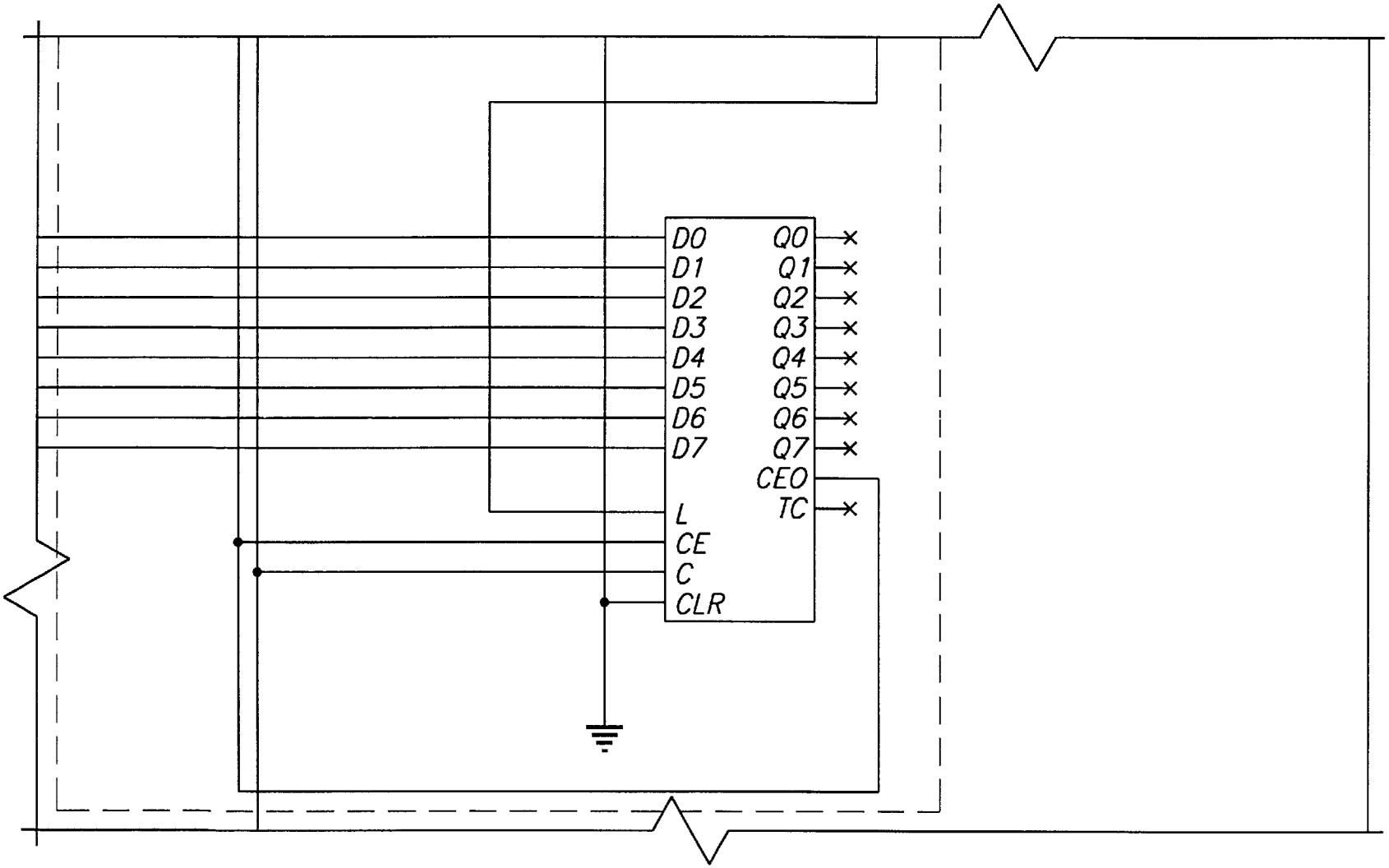
Figure 18:
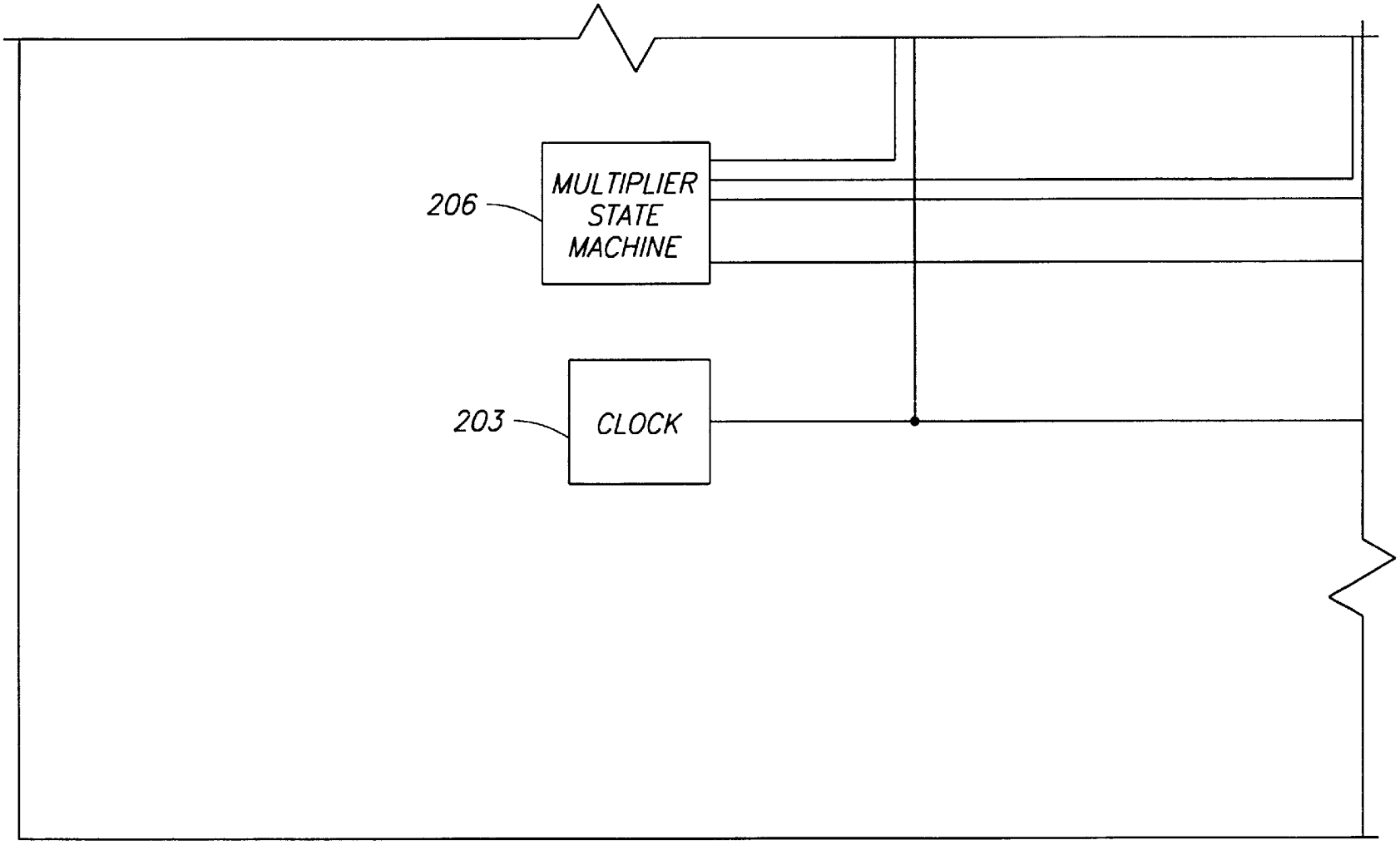
Figure 8K:
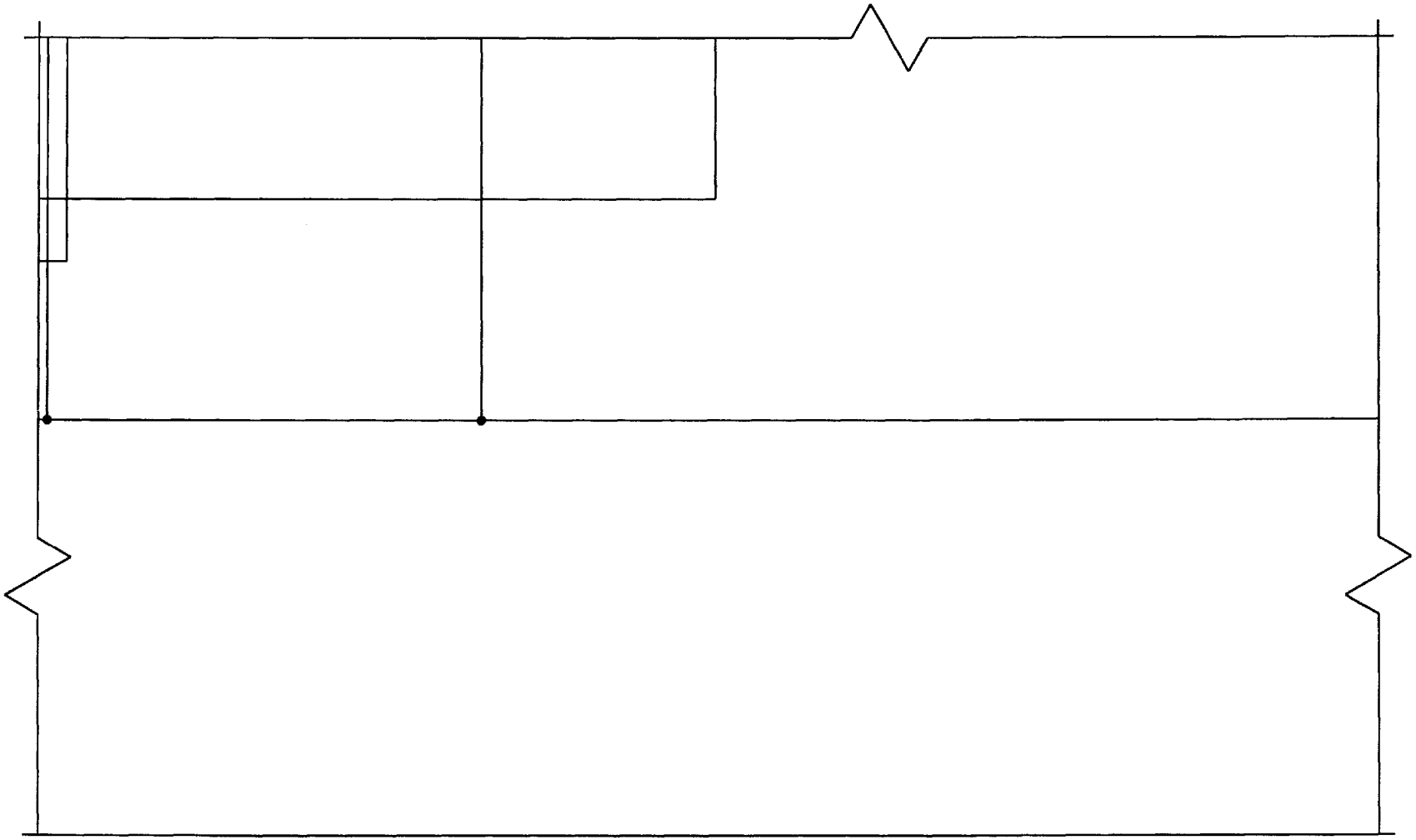
Figure 18:
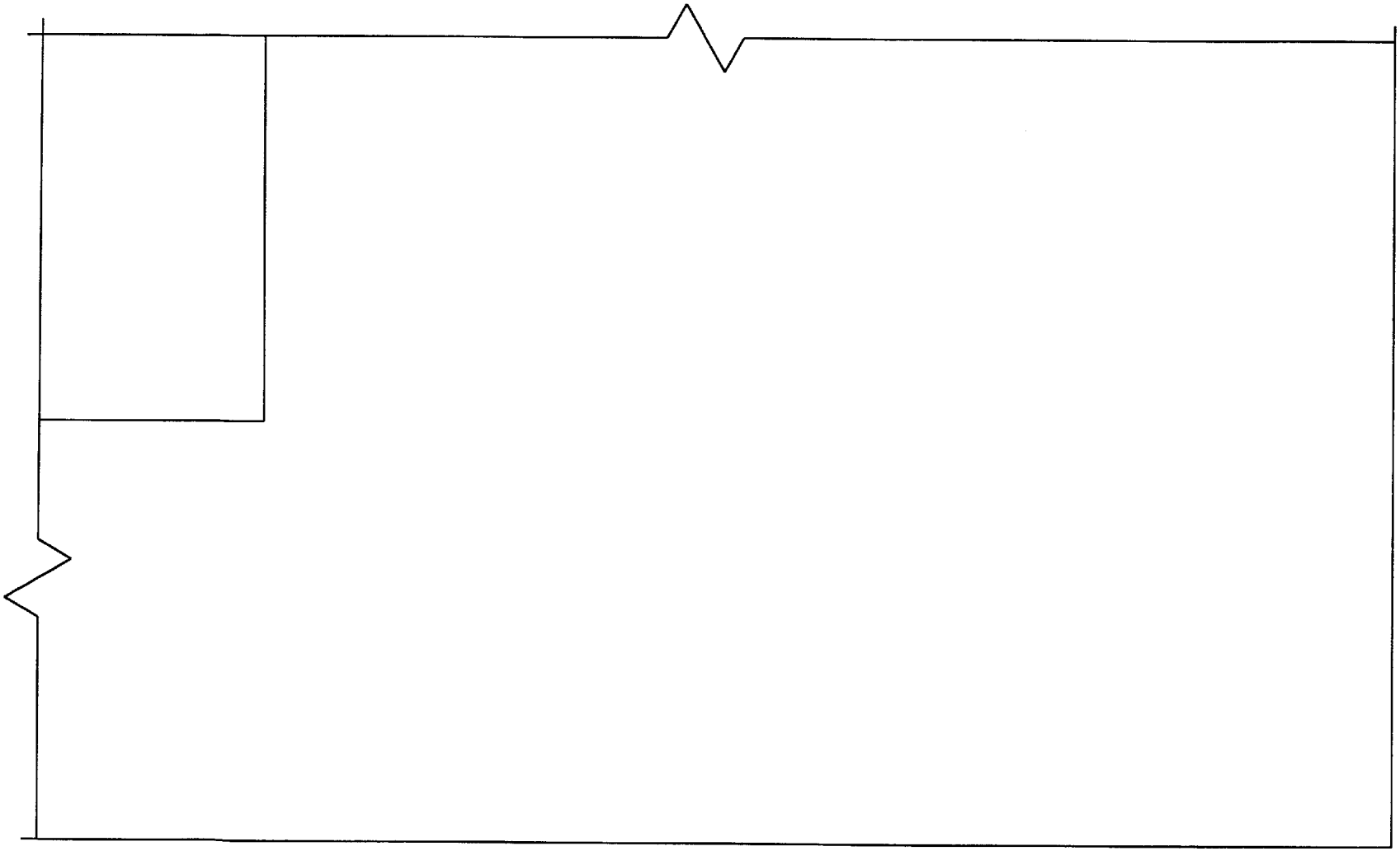

If the least significant bit of the multiplier is a one, the recirculate occurs as before but the two outputs are now passed through serial adder 216 with carry (shown in FIG. 8B). The output of the serial adder 216 is routed to the input of the result register 214 and the multiplicand register is again precessed by one location. The carry bit is cleared after this operation.

The value of the next multiplier bit is analyzed following either the recirculation responsive to the previous bit being a zero, or recirculation in combination with passage through the serial adder 216 responsive to the previous bit being a one. This sequence of analysis is repeated for all 13 bits of the multiplier within divider register 208. Following complete analysis of the multiplier, the result register 216 contains the 27-bit result of the multiplication. The divide function is accomplished by mapping the 13 most significant bits of the result register 214 into the 13-bit holding register 218 (shown in FIGS. 8E and 8H).

The programmable counter 220 (shown in FIGS. 8F and 8I) may be automatically reloaded on overflow. Since the calculated value in the holding register 218 is the prescaled system clock value, the overflow output of programmable counter 220 is the RFTACH signal. The LINETACH is determined by dividing the RFTACH signal by 11 utilizing the postscalar 222. The shift register 212 for the multiplier is updated at the start of a new LINETACH period to provide a constant period of the RFTACH signals within each LINETACH period.

The imaging process of printer 10 is configured to start at the top of form "TOF" of a sheet of continuous media 22 as indicated via direct signal from media controller 112. Thus, an error value may be determined corresponding to creep within printer 10 based upon the top of form indications. The error value is the difference between the end of the imaged data (latent image) and the TOF mark of the next sheet (i.e., top of a subsequent form) of the continuous media 22 (also indicating the bottom of the currently printed form).

In particular, image controller 108 in one embodiment is configured to image 3300 scan lines (for one 11 inch form) corresponding to 300 scan lines per inch responsive to receiving a TOF indication. Following completion of the imaging of 3300 scan lines, image controller 108 awaits reception of the next TOF signal from media controller 112. Image controller 108 may be configured to print white lines (i.e., referred to as padding) until the next TOF indication is received. Image controller 108 counts the number of white lines responsive to receiving the next TOF indication. The number of white lines printed corresponds to the error. A fault condition occurs if the TOF flag is set prior to the completion of imaging of the current form.

The print resolution of the latent image formed by print head 62 is varied via recalculation of the ratio to reduce the measured difference (error) to an acceptably small value.

Responsive to the error measurement, the multiplier of divide register 208 is varied to increase or decrease resolution. In one example, the resolution is increased if less than four white lines are generated. The resolution is decreased if more than seven white lines are generated. It is preferred to maintain the number of printed white lines between four and seven.

Figure 9:
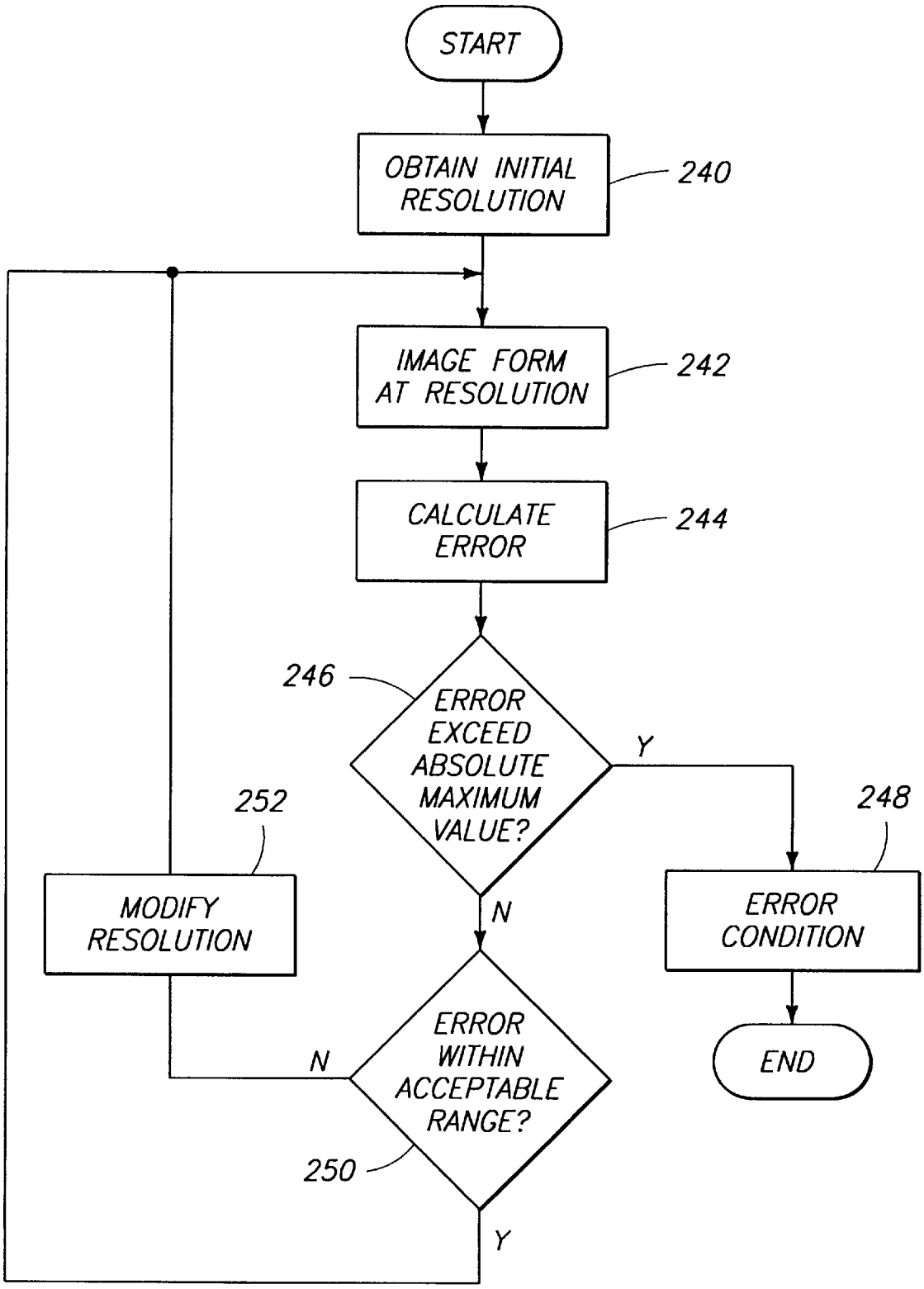
FIG. 9 is a flow chart illustrating one method of adjusting the resolution of images formed by the printer.

Referring to FIG. 9, a method of varying the print resolution according to error is described in detail. Following start-up of printer 10, the processor of image controller 108 obtains the initial resolution at step 240.

In the described method, a nominal default resolution is utilized as the initial resolution to form the first few images. An appropriate multiplier within register 208 is selected by image controller 108 to provide the nominal default resolution. The first print jobs run through a particular printer 10 will use the default resolution. Thereafter, modifications to the resolution will occur to reduce error during the print jobs. The default resolution should be chosen to assure that a complete image will be printed upon a form to provide an error calculation. The default resolution is 305 dpi in the described embodiment of the invention.

Following printing through the printer 10 for a period of time, the initial resolution is based upon past acquired error and print resolution information. Therefore, in the described embodiment, the initial resolution value may be tailored to the individual printer following actual printing inasmuch as creep will typically vary from printer to printer. For example, the elasticity of the drums of the imaging assembly 60 may vary from printer to printer. Such tailoring of the initial resolution value characterizes the particular printer 10 being utilized. After the default resolution is modified, an updated initial resolution value is thereafter utilized in step 240 in accordance with the described embodiment.

Image controller 108 proceeds to step 242 to image a current form according to the initial resolution. Subsequent to the imaging, image controller 108 is configured to calculate error at step 244 corresponding to the formed latent image according to the method described above (e.g., number of white lines or pad lines imaged until assertion of a top of form mark corresponding to a subsequent form).

At steps 246 and 250, image controller 108 analyzes the results of the error calculation. The described analysis determines whether an error condition has occurred, and whether modification of the imaging resolution by image controller 108 is necessary at step 252. In one embodiment, various values are chosen to define a plurality of bands for implementing such an error analysis.

A first band indicates the presence of an error condition. The first band is defined by an absolute maximum error value. Analysis at step 246 determines whether the measured error exceeds the absolute maximum value. Printer 10 interrupts imaging and printing at step 248 if the amount of error (e.g., number of imaged white lines) exceeds the absolute maximum error value. The presence of error exceeding the absolute maximum value may indicate that the media controller 112 is unable to locate a top of form mark or other error conditions. In the described embodiment, the absolute maximum value is 44.

If the measured error value is less than the absolute maximum value, the image controller processor analyzes the error with respect to other bands at step 250. The analysis at step 250 determines whether the measured error is within an acceptable range.

In the described embodiment of the present invention, a second band is defined by the absolute maximum value and a maximum value. If the amount of error falls between the absolute maximum value and the maximum value, then the error is outside an acceptable range and sizable changes are made to the print resolution at step 252. In particular, the resolution is preferably decreased by 0.5 to 1 dpi responsive to error calculations falling within this particular band. The maximum value is 10 in the described embodiment.

The maximum value and a nominal value define a third error band. If the amount of error falls between the maximum value and the nominal value, then the error is again outside the acceptable range and changes of smaller increments are made to the print resolution at step 252. In particular, the resolution is preferably decreased by ⅛ dpi responsive to error calculations falling within this particular band. The nominal value is 10 in one embodiment.

The nominal value and a minimum value define a fourth error band. If the amount of error falls between the nominal value and the minimum value, then the error is within an acceptable range and no changes are made to the print resolution. The minimum value is 4 in one embodiment. Generally, a small amount of error is tolerated due to jitter within the printing process of printer 10. Thus, an acceptable error range is provided. Such small amounts of error are typically not visible to the human eye.

Tachometer synthesizer 200 of image controller 108 is operable to modify the imaging resolution at step 252 responsive to error being outside an acceptable range. Image controller 108 applies an appropriate multiplier to divider register 208 to provide the appropriate ratio for implementing the desired change on resolution. As described above, multiplier and counter 210 of the tachometer synthesizer 200 accesses the 14 bit output of the period counter 201 and multiplies it by the ratio of 87.38 (counts per lineal inch provided by the imaging drum tachometer) divided by the desired LINETACH resolution. The desired LINETACH resolution is varied responsive to the indicated error and the band associated therewith. Varying the LINETACH resolution implements the desired change of the resolution (e.g., 1 dpi, 0.5 dpi or ⅛ dpi).

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A method of forming an image comprising:

providing media at a print velocity;

providing an imaging drum;

providing a first reference signal corresponding to a resolution of the imaging drum and the print velocity;

converting the first reference signal to a second reference signal corresponding to a target resolution;

forming an image upon media according to the second reference signal, the forming comprising forming an electrostatic latent image upon the imaging drum using a print head;

following the forming, outputting media having the image thereon; and adjusting the second reference signal responsive to the forming.

2. The method according to claim 1 wherein the media comprises continuous form media.

3. The method according to claim 1 further comprising adjusting the resolution of the latent image responsive to the adjusting the second reference signal.

4. The method according to claim 1 further comprising calculating an error value and the adjusting being responsive to the calculating.

5. The method according to claim 4 wherein the adjusting is responsive to the error value being outside an acceptable range.

6. The method according to claim 4 wherein the calculating comprises measuring from the end of a latent image to a top of a subsequent form.

7. The method according to claim 1 wherein the forming the electrostatic latent image comprises scanning a plurality of drive lines in the print head responsive to the second reference signals.

8. The method according to claim 7 wherein the adjusting varies the timing of the generating of the second reference signals.

9. The method according to claim 1 wherein the forming further comprises:

developing the latent image; and offsetting the developed image onto the media.

10. The method according to claim 9 wherein the developing comprises applying toner to the latent image.

11. The method according to claim 1 further comprising varying the resolution of the latent image.

12. The method according to claim 1 further comprising monitoring rotational velocity of the imaging drum above a predetermined threshold.

13. The method according to claim 1 wherein the second reference signal has a higher frequency than the first reference signal.

14. The method according to claim 1 wherein the converting comprises multiplying the first reference signal by a ratio and adjusting the ratio provides the adjusting of the second reference signal.

15. A method of forming images upon media comprising:

providing media at a print velocity;

providing a plurality of images;

forming the images upon an imaging drum including:

generating a plurality of drive signals corresponding to a target resolution; and scanning a plurality of drive lines of a print head responsive to the drive signals;

adjusting the resolution of the images;

offsetting the images from the imaging drum to the media; and outputting the media following the offsetting.

16. The method according to claim 15 further comprising monitoring rotational velocity of the imaging drum above a predetermined threshold.

17. The method according to claim 15 wherein the media comprises continuous form media.

18. The method according to claim 15 wherein the forming comprises forming electrostatic latent images.

19. The method according to claim 18 wherein the adjusting comprises adjusting the resolution of the latent images.

20. The method according to claim 18 further comprising developing the latent images prior to the offsetting.

21. The method according to claim 20 wherein the developing comprises applying toner to the latent images.

22. the method according to claim 15 further comprising varying the timing of the generating of the drive signals to provide the adjusting.

23. The method according to claim 15 wherein the generating is responsive to a reference signal corresponding to a resolution of the imaging drum and the print velocity.

24. The method according to claim 23 further comprising:

calculating an error value; and adjusting the target resolution responsive to the calculating.

25. The method according to claim 15 further comprising calculating an error value and the adjusting being responsive to the calculating.

26. The method according to claim 25 wherein the adjusting is responsive to the error value being outside an acceptable range.

27. The method according to claim 25 wherein the calculating comprises measuring from the end of a latent image to a top of a subsequent form.

28. A method of forming an image comprising:

providing media at a print velocity;

providing a plurality of images;

first forming a plurality of latent images corresponding to the provided images including:

generating a plurality of drive signals corresponding to a target resolution; and scanning a plurality of drive lines of a print head responsive to the drive signals;

to adjusting the resolution of the latent images;

second forming the images upon the media; and outputting the media following the second forming.

29. The method according to claim 28 wherein the media comprises continuous form media.

30. The method according to claim 28 wherein the forming comprises forming electrostatic latent images on an imaging drum.

31. The method according to claim 30 further comprising monitoring rotational velocity of the imaging drum above a predetermined threshold.

32. The method according to claim 28 wherein the second forming comprises:

developing the latent images; and offsetting the developed images to the media.

33. The method according to claim 32 wherein the developing comprises applying toner to the latent images.

34. The method according to claim 28 further comprising calculating an error value and the adjusting being responsive to the calculating.

35. The method according to claim 34 wherein the adjusting is responsive to the error value being outside an acceptable range.

36. The method according to claim 34 wherein the calculating comprises measuring from the end of one of the latent images to a top of a subsequent form.

37. The method according to claim 28 wherein the adjusting comprises varying the timing of the generating of the drive signals.

38. The method according to claim 28 wherein the generating is responsive to a reference signal corresponding to the resolution of an imaging drum and the print velocity.

39. The method according to claim 38 further comprising:

calculating an error value; and adjusting the target resolution responsive to the calculating.

40. The method according to claim 39 wherein the adjusting is responsive to the error value being outside an acceptable range.

41. A method of forming an image comprising:

providing media at a print velocity;

providing a first reference signal;

converting the first reference signal to a second reference signal;

forming an image upon media according to the second reference signal;

following the forming, outputting media having the image thereon;

calculating an error value including measuring from the end of a latent image to a top of a subsequent form; and adjusting the second reference signal responsive to the forming and the calculating.

42. A method of forming images upon media comprising:

providing media at a print velocity;

providing a plurality of images;

forming the images upon an imaging drum;

adjusting the resolution of the images;

offsetting the images from the imaging drum to the media;

outputting the media following the offsetting; and calculating an error value including measuring from the end of a latent image to a top of a subsequent form, and the adjusting being responsive to the calculating.

* * * * *

UNITED STATES PATENT AND TRADEMARK OFFICE

CERTIFICATE OF CORRECTION

PATENT NO : 6,075,548

DATED : June 13, 2000

INVENTOR(S) : John D. Gillen

It is certified that error appears in the above-identified patent and that said Letters Patent are hereby corrected as shown below:

Col. 16, Line 60, delete "to".

Signed and Sealed this

First Day of May, 2001

Nicholas P. Godici

*Attest:*

NICHOLAS P. GODICI

*Attesting Officer*

*Acting Director of the United States Patent and Trademark Office*